US005513407A

United States Patent [19]

Reinert, Sr.

[11] Patent Number: 5,513,407

[45] **Date of Patent: * May 7, 1996**

[54] REINFORCED FULL BODY SUIT

[76] Inventor: Gary L. Reinert, Sr., 4319 Middle Rd., Allison Park, Pa. 15101

[ * ] Notice: The portion of the term of this patent subsequent to Jul. 19, 2011, has been disclaimed.

[21] Appl. No.: 273,465

[22] Filed: Jul. 11, 1994

Related U.S. Application Data

[63] Continuation-in-part of Ser. No. 239,215, May 6, 1994, Pat. No. 5,421,048, which is a continuation-in-part of Ser. No. 58,244, May 10, 1993, Pat. No. 5,329,659.

[51] Int. Cl.[6] ..... D06F 35/00

[52] U.S. Cl. ..... 8/158; 8/159

[58] Field of Search ..... 8/158, 159; 68/3 R, 68/208, 210; 454/238, 239, 253; 55/385.2; 210/806, 96.1, 104, 143, 257.1, 314, 340; 134/25.4

[56] References Cited

U.S. PATENT DOCUMENTS

| | | | |
|---|---|---|---|
| 105,856 | 7/1970 | Sloan | 2/231 |
| 199,273 | 1/1978 | Davis | 2/231 |
| 249,596 | 11/1981 | Douglass | 2/231 |
| 337,316 | 3/1986 | Erlanger | 2/231 |
| 367,198 | 7/1987 | Diggs | 2/231 |
| 375,958 | 1/1988 | Skeffington | 2/16 |
| 386,240 | 7/1988 | Erlanger | 2/231 |
| 509,693 | 11/1993 | Sheppard | 2/231 |
| 1,304,613 | 5/1919 | Smedley | 2/227 |
| 1,366,809 | 1/1921 | Kenrick . | |
| 1,471,507 | 10/1923 | Smith | 2/79 |
| 1,654,452 | 12/1927 | Bradley . | |
| 1,711,611 | 5/1929 | Mock | 2/227 |
| 1,777,620 | 10/1930 | Modesitt | 2/23 |
| 1,967,940 | 7/1934 | Johnson | 68/3 R X |
| 2,099,620 | 11/1937 | Pleiter et al. | 2/79 |
| 2,283,362 | 5/1942 | Hamilton | 2/227 |
| 2,346,082 | 4/1944 | Riedl | 2/227 |
| 2,568,083 | 9/1951 | Mitchell | 2/231 |
| 3,496,572 | 2/1970 | Herzig | 2/2 |
| 3,611,906 | 10/1971 | Lorenz | 454/238 |
| 3,691,564 | 9/1972 | La Marre et al. | 2/2 |
| 4,195,362 | 4/1980 | Rolando | 2/2 |
| 4,441,340 | 4/1984 | Kaplan | 68/208 X |

(List continued on next page.)

FOREIGN PATENT DOCUMENTS

| | | | |
|---|---|---|---|
| 0200086 | 10/1958 | Austria | 2/79 |
| 2256729 | 8/1975 | France | 2/79 |
| 2543046 | 4/1977 | Germany | 2/79 |
| 38541 | 3/1984 | Japan | 454/238 |
| 0115339 | 11/1945 | Sweden | 2/79 |
| 0000482 | of 1878 | United Kingdom | 2/231 |

*Primary Examiner*—Philip R. Coe
*Attorney, Agent, or Firm*—Douglas G. Glantz

[57] ABSTRACT

A launderable reinforced full body suit is disclosed composed of a launderable environmentally contained, flexible, light weight base garment and launderable, flexible, light weight, heavy duty reinforcements on the base garment to provide a protective knee, seat, and elbow composed of a flexible, light weight material for providing heavy duty wear resistance through successive recycle and reuse, and a launderable protective sleeve composed of a flexible, light weight aramid fibers material for providing heavy duty penetration resistance from shot blasting.

A decontamination process for laundering the reinforced full body suit includes providing a washer area, a washer and dryer for laundering the contaminated reinforced full body suit in the washer area, a cleaning fluid filtering area for automatically monitoring and controlling cleaning fluid quality discharged from the washer area to the outside environment, a clean area for working on decontaminated clothes received from the washer area, automatically monitoring and controlling air quality in the washer area, in the cleaning fluid filtering area, in the clean area, and for air quality discharged to the outside environment, and recycling and reusing the laundered and decontaminated reinforced full body suit.

20 Claims, 9 Drawing Sheets

U.S. PATENT DOCUMENTS

| | | | |
|---|---|---|---|
| 4,470,156 | 9/1984 | Duerbeck et al. | 2/227 |
| 4,608,716 | 9/1986 | Brumfield | 2/2.5 |
| 4,820,319 | 4/1989 | Griffis | 55/385.2 X |
| 4,890,336 | 1/1990 | Worton | 2/79 |
| 4,922,551 | 5/1990 | Anthes | 2/79 |
| 5,003,794 | 4/1991 | Griffis | 68/210 X |
| 5,004,483 | 4/1991 | Eller et al. | 55/385.2 X |
| 5,005,216 | 4/1991 | Blackburn et al. | 2/79 |
| 5,007,112 | 4/1991 | Lewis, Jr. et al. | 2/79 |
| 5,023,953 | 6/1991 | Bettcher | 2/126 |
| 5,038,408 | 8/1991 | DeBaene | 2/23 |
| 5,044,011 | 9/1991 | Henderson | 2/2.5 |
| 5,064,457 | 11/1991 | Weber | 55/385.2 |
| 5,088,116 | 2/1992 | Gould | 2/82 |
| 5,090,053 | 2/1992 | Hayes | 2/2 |
| 5,099,751 | 3/1992 | Newman et al. | 454/239 X |
| 5,208,919 | 5/1993 | Fields | 2/123 |
| 5,219,367 | 6/1993 | Fields | 2/227 |
| 5,246,590 | 9/1993 | Dobrez et al. | 210/96.1 X |
| 5,247,708 | 9/1993 | Freese, Jr. | 2/79 |

PA
PB
PC
36
37
40
41
42
43
52
53
88
89
90
91
92
93
98
109
110
111
112
113
114
115
116
117
1g

REINFORCED FULL BODY SUIT

This patent application is a continuation-in-part of prior patent application U.S. Ser. No. 08/239,215 filed May 6, 1994, and now U.S. Pat. No. 5,421,048, which was in turn a continuation-in-part of prior, co-pending U.S. patent application Ser. No. 08/058,244 filed May 10, 1993, and now U.S. Pat. No. 5,329,659.

BACKGROUND OF THE INVENTION

1. Technical Field

This invention relates to a launderable reinforced body suit and to a decontamination process for laundering the contaminated reinforced body suit and decontaminating the suit in an environmentally contained, controlled, and safe facility.

2. Background of the Invention

The contamination of our living environment with hazardous materials and listed contaminants, e.g., such as asbestos and/or lead, silica dust, titanium dioxide dust, or carbon dust is a serious, but well known problem. Abatement programs, for instance, of the asbestos and/or lead, silica dust, titanium dioxide dust, or carbon dust contaminants from buildings of all types and other structures such as public bridges are major undertakings costing billions of dollars every year.

During the abatement processes for removing these and other contaminants, workers are required to wear protective clothing in addition to respirators equipped with HEPA (high efficiency particulate absolute) filter cartridges.

Conventional protective clothing includes heavy duty rubber suits which do not work well because they are heavy, bulky, and hot to wear, especially in conjunction with or during rigorous physical activity by the wearer.

U.S. Pat. No. 5,005,216 discloses a self-ventilating, totally encapsulating protective garment having a hood covering the operator's head. Pressurized air fed to the suit facilitates breathing and provides a cooling effect.

U.S. Pat. No. 3,496,572 discloses a dust-proof body suit having arm inner sleeve 13 and outer sleeve 14 and leg inner sleeve 17 and outer sleeve 19.

The protective clothing typically is disposed after use as contaminated material. Throw-away disposal aggravates another serious problem, i.e., the build-up of large quantities of contaminated solid waste, thereby increasing an already heavy burden imposed on landfills nationwide in addition to the cost of replacing the contaminated clothing.

Recycling has become a serious obligation of every citizen, and it is becoming law in many instances. Recycling by laundering the clothing used in the abatement projects for asbestos and lead, silica dust, titanium dioxide dust, or carbon dust could become a major contribution to the reduction of the solid waste problem, so long as the following protections are provided.

a. Safety procedures and facilities are included in the laundering process to protect the operator's health and to protect the surrounding atmosphere and water resources from contamination.
b. Methods and facilities are in place to prevent the clothing from becoming re-contaminated within the work area of the laundering facility, after they have been laundered and before they leave the laundering facility.
c. Any quantity of the contaminants found on the laundered suits, after they exit the laundering facility, is limited to insignificant levels or at most the maximum allowed by regulations.

d. No waste water will be disposed through the sewer system which is not in compliance with EPA regulations for maximum allowable content for the above-mentioned contaminants.

Requirements to take waste water samples, exhaust air samples, containment area and cleaning fluid filtering area air samples, and their analyses arise because discharges are regulated from facilities with a potential for contaminating the nation's environments, including worker environments. Discharges are regulated by federal, state, and local agencies, e.g., such as by the EPA, OSHA, and others which have established regulations and standards and which police and enforce such regulations and standards for waste water and air discharges to the outdoor environment and to operator work areas.

The protective clothing available commercially today typically is designed to be disposable and suffers from the drawback that the clothing wears out quickly during normal use. Such disposable clothing also suffers from an inability to undergo any laundering process, much less the rigorous laundering required to remove hazardous materials from the contaminated clothing. Accordingly, a new body suit is needed which does not wear out quickly through successive use under normal industrial wear conditions or through the laundering process.

U.S. Pat. No. 4,608,716 discloses a reinforced jump suit to provide a one-piece garment containing safety and injury-preventive features for industrial workers. Knee supports 304 are made of Nomex aramid fiber. Knee padding 308 is provided by a high density flexible plastic foam. Elbow supports 343 are of Nomex. The patent teaches that Kevlar should not be commercially laundered. (Col. 14, lines 47–60.)

U.S. Pat. No. 5,208,919 discloses a coat having an outer layer of Nomex or Kevlar and an inner layer of Gore-Tex.

U.S. Pat. No. 5,088,116 discloses removable forearm gaiters and leg gaiters to provide abrasion resistance.

U.S. Pat. No. 5,023,953 discloses a detachable protective sleeve and is a representative example of many detachable protectors.

U.S. Pat. No. 3,691,564 discloses a protective sleeve 20 which can be a glass fiber reinforced metallized non-combustible plastic. The protective sleeve 20 extends from just above the wrist to about the tricep level and is oriented to cover the wearer's arm exposed to working such as welding.

U.S. Pat. No. 375,958 discloses a protective sleeve to cover the wearer's arm exposed to working such as plastering.

German Offenlegungsschrift No. 2,543,046 discloses knee, seat, and elbow reinforcements.

French patent application No. 2,256,729 discloses knee, seat, and elbow reinforcements for abrasion resistance and protection against light missiles.

It is an object of the present invention to provide novel protective clothing.

It is another object of the present invention to provide novel protective clothing for wearing during removal of contaminants from living areas.

It is another object of the present invention to provide novel protective clothing for wearing during removal of contaminants from our living environment in the abatement of hazardous materials and listed contaminants such as asbestos and/or lead, silica dust, titanium dioxide dust, or carbon dust.

It is an object of the present invention to provide a novel decontamination process for laundering such contaminated protective clothing and to provide safety devices, procedures, controls, and regular testings as an intrinsic part of the laundering process.

It is another object of the present invention to provide a decontamination process for laundering and decontaminating various types of woven and non-woven fabric, permeable and impermeable protective clothing.

It is another object of the present invention to provide a novel decontamination process for testing the protective clothing at regular predetermined intervals by an independent laboratory for contaminant content, prior to and after laundering, to provide the laundered protective clothing does not get re-contaminated within the laundering facility.

It is a further object of the present invention to provide novel launderable protective clothing and facilities and methods for laundering contaminated protective clothing to protect the laundry operator's health and to protect the surrounding atmosphere from being contaminated with the listed contaminants from the laundering process.

A further object of the present invention is to provide novel launderable protective clothing and decontamination process for laundering asbestos and/or lead, silica dust, titanium dioxide dust, or carbon dust from such launderable protective clothing contaminated with asbestos and/or lead, silica dust, titanium dioxide dust, or carbon dust including facilities and methods combining microprocessor-controlled washer technology with a containment-area-controlled environment.

A further object of the present invention is to provide novel launderable protective clothing and a decontamination process for laundering asbestos and/or lead, silica dust, titanium dioxide dust, or carbon dust from such contaminated launderable protective clothing to decontaminate the launderable protective clothing in commercial laundries to provide a product that can be safely and comfortably worn through successive recycle and reuse.

These and other objects of the present invention will become apparent from the detailed description which follows.

SUMMARY OF THE INVENTION

The present invention includes a launderable reinforced full body suit composed of a launderable environmentally contained, flexible, light weight base garment and launderable, flexible, light weight, heavy duty reinforcements on the base garment to provide a protective knee, seat, and elbow composed of a flexible, light weight material for providing heavy duty wear resistance through successive recycle and reuse. In one aspect, a launderable protective sleeve composed of flexible, light weight aramid fibers material provides heavy duty penetration resistance from shot blasting.

A decontamination process for laundering the reinforced full body suit includes providing a washer area, a washer and dryer for laundering the contaminated reinforced full body suit in the washer area, a cleaning fluid filtering area for automatically monitoring and controlling cleaning fluid quality discharged from the washer area to the outside environment, a clean area for working on decontaminated clothes received from the washer area, automatically monitoring and controlling air quality in the washer area, in the cleaning fluid filtering area, in the clean area, and for air quality discharged to the outside environment, and recycling and reusing the laundered and decontaminated reinforced full body suit.

BRIEF DESCRIPTION OF THE DRAWINGS

FIG. 5 shows an electronic liquid level control device installed on a sample receiving container, a three-channel programmable, electronic timer and three independent contacts, three high volume air pumps, three sampling cassettes, three blinking lights of diverse colors, electrically operated relays, and a horn. A partial piping schematic diagram shows piping for the waste water samples to flow through, with direction of flow indicated by arrows, and three valves, including a tri-way, motorized valve.

FIG. 9 partially shows schematically the piping for a waste water sample to flow through, with the direction of the waste water flow indicated by arrows, valves including a tri-way, motorized valve, a container to receive a waste water sample, and an electronic level control device installed on the container.

FIG. 12 also shows an electronic liquid level control device installed on a container, a three-channel programmable, electronic timer, its three independent contacts, three high volume air pumps, three blinking lights of diverse colors, electrically operated relays, and a horn. A partial piping schematic diagram shows piping for the waste water samples to flow through, with direction of flow indicated by arrows, and three valves, including a tri-way, motorized valve.

DETAILED DESCRIPTION

The present invention provides a novel reinforced body suit and a decontamination process for laundering contaminated reinforced body suits and decontaminating the novel reinforced body suits in an environmentally contained, controlled, and safe facility.

The present invention includes a flexible, light-weight, full-body uniform reinforced at the sleeves, knees, and seat with a flexible, light-weight, heavy duty material. Preferably, the material at the sleeves is non-penetrable, and the material at the knees and seat is wear resistant. The material at the sleeves is non-penetrable to withstand shot blasting.

In one aspect, the present invention includes a novel launderable reinforced body suit.

In one aspect, the novel body suit is launderable in an asbestos and/or lead or other listed contaminant laundering facility to make the body suit recyclable and reusable through successive reuse after laundering subsequent to being used for removing asbestos from buildings or after shot blasting old painted structures, e.g., surfaces painted with lead-based paints or contaminated with other listed contaminants.

The flexible base garment preferably is composed of a polyester and cotton with a weight, by way of example, of about 3.7 oz./sq. yard and a thread count of 110×76. In one aspect, the flexible heavy duty material is composed of Kevlar aramid fibers and weighs, by way of example, about 8 oz./sq, with a total weight of the uniform of less than about 1.44 lbs. In another aspect, the flexible heavy duty material is composed of denim weighing, by way of example, about 12 oz./sq, with a total weight of the uniform of less than about 1.69 lbs.

Figure 1:
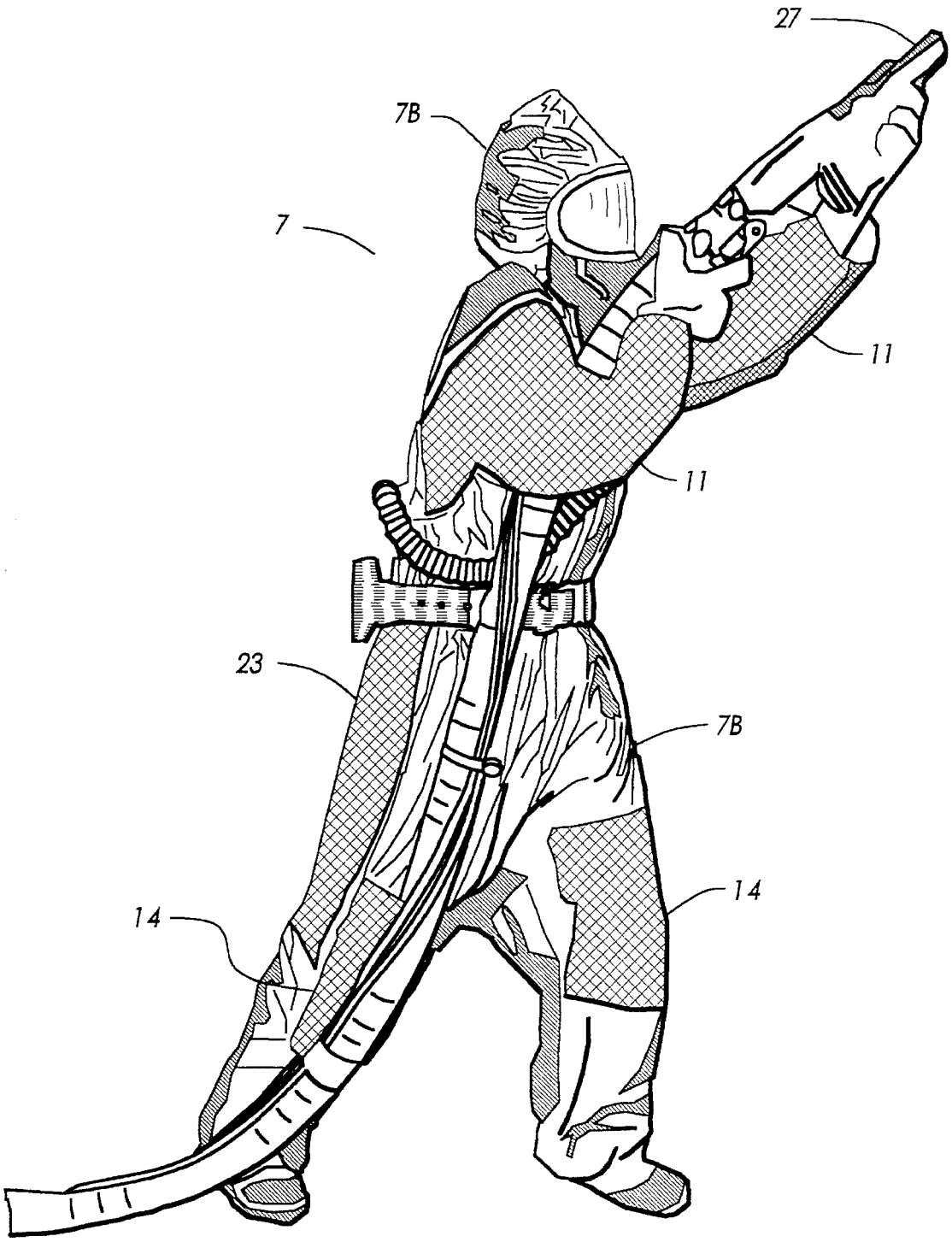
FIG. 1 is a perspective view of a reinforced full body suit in accordance with the present invention.

FIG. 1 provides a perspective view of a reinforced full body suit in accordance with the present invention as observed in service with a worker applying shot blasting to a structure to be stripped of contaminants, e.g., such as a public bridge structure coated with lead-based paint.

Referring now to FIG. 1, body suit 7 is a full body suit for covering and protecting exposed areas of a worker's body while working to remove hazardous materials such as asbestos, or lead, silica dust, titanium dioxide dust, or carbon dust.

Body suit 7 includes a flexible, light-weight, full-body uniform reinforced at the sleeves 11, knees 14, and seat 23 with a flexible, light-weight, heavy duty material.

Preferably, the reinforcing material at sleeves 11 is non-penetrable, and the material at the knees 14 and seat 23 is wear resistant.

Sleeve 11 preferably is constructed of penetration resistant material because it has been found that shot blasting, e.g., through shot blasting gun nozzle 27, of contaminated structures, e.g., such as for stripping lead-based paint from bridge structures, causes the sleeve material to degrade from penetration of the rebounding shot material when a worker's arm is uplifted as shown in FIG. 1 in position to direct the shot material at the structure to be shot blasted.

The novel launderable reinforced body suit is launderable in an asbestos and/or lead or other listed contaminant laundering facility to make the body suit recyclable and reusable through successive reuse after laundering subsequent to being used for removing asbestos from buildings or after shot blasting old painted structures, e.g., surfaces painted with lead-based paints or contaminated with other listed contaminants.

The flexible base garment 7B preferably is composed of a polyester and cotton with a weight, by way of example, of about 3.7 oz./sq. yard and a thread count of 110×76. In one aspect, the flexible heavy duty material for sleeves 11 is composed of Kevlar aramid fibers and weighs, by way of example, about 8 oz./sq. yard, with a total weight of the uniform of less than about 1.44 lbs. For fire retardance, Nomex aramid fibers are used in substitution of or in combination with the Kevlar material. In another aspect, the flexible heavy duty material for knees 14 and seat 23 is composed of denim weighing, by way of example, about 12 oz./sq. yard, with a total weight of the uniform of less than about 1.69 lbs.

Figure 2B:
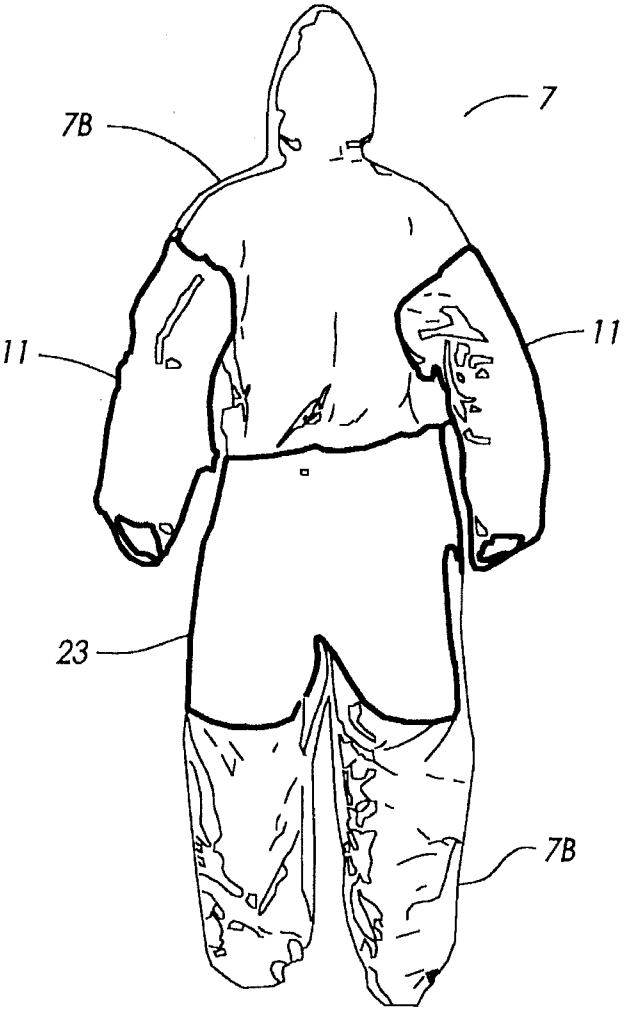
FIGS. 2A and 2B provide frontal and rear views of a reinforced full body suit in accordance with the present invention.
Figure 2A:
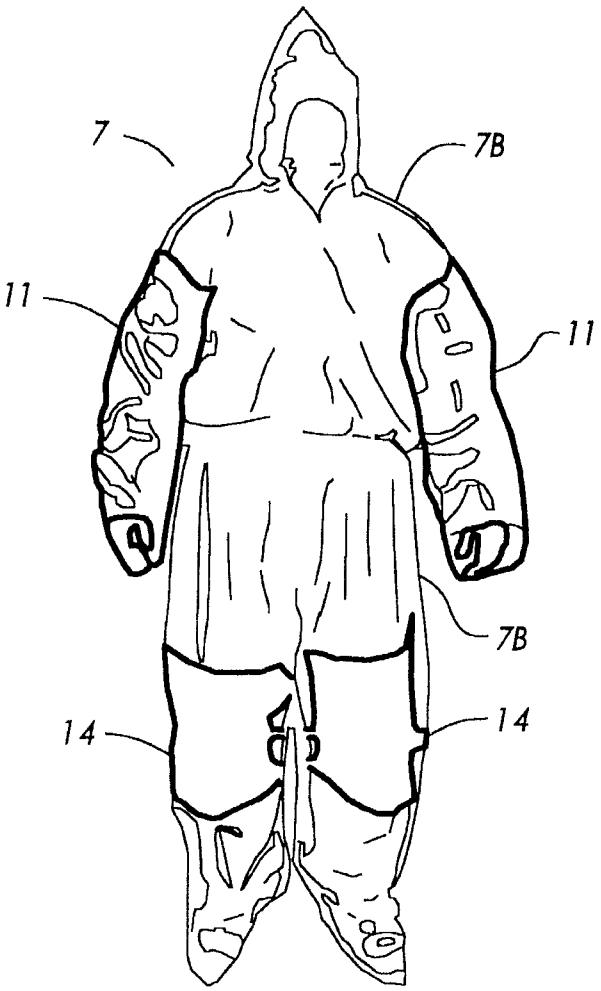

FIG. 2A is a frontal perspective view of a reinforced full body suit in accordance with the present invention.

Referring now to FIG. 2A, body suit 7 includes a flexible, light-weight, full-body uniform reinforced at the sleeves 11, knees 14, and seat 23 with a flexible, light-weight, heavy duty material.

Preferably, the reinforcing material at sleeves 11 is non-penetrable, and the material at the knees 14 and seat 23 is wear resistant. The material at sleeves 11 is non-penetrable to withstand shot blasting.

The flexible base garment 7B preferably is composed of a polyester and cotton with a weight, by way of example, of about 3.7 oz./sq. yard and a thread count of 110×76. In one aspect, the flexible heavy duty nonpenetrable material for sleeves 11 is composed of Kevlar aramid fibers and weighs, by way of example, about 8 oz./sq, with a total weight of the uniform of less than about 1.44 lbs. In another aspect, the flexible heavy duty wear resistant material for knees 14 and seat 23 is composed of denim weighing, by way of example, about 12 oz./sq, with a total weight of the uniform of less than about 1.69 lbs.

Specified dimensions for sleeves 11 include dimensions of about 19.5 inches long by 18 inches wide because this additional protection is needed to resist the steel shot rebound.

Specified dimensions for knees 14 include dimensions of about 12.5 inches long by 10 inches wide because this additional protection is needed to resist when kneeling to perform shot blasting operations.

FIG. 2B is a rear perspective view of a reinforced full body suit in accordance with the present invention.

Referring now to FIG. 2B, body suit 7 is shown from a rear perspective. Seat 23 is shown more prominently, and the different view of body suit 7 shows its flexibility for movement.

Specific dimensions for seat 23 include dimensions of about 20 inches long by 27 inches wide because this additional protection is needed to resist when sliding or shimmying up and down a steel beam.

The present invention provides decontamination process and facilities for laundering a contaminated reinforced full body suit, e.g., such as contaminated with asbestos fibers and/or with lead, silica dust, titanium dioxide dust, or carbon dust, herein called the listed contaminants. The decontamination process of the present invention is employed to decontaminate the reinforced protective clothing in an environmentally contained, controlled, and safe facility. The decontamination process of the present invention permits contaminated reinforced protective clothing to be brought into the containment area, laundered, and dried within the same contained, environmentally controlled, safe area. Clean reinforced protective clothing then is removed for further sorting, repair, folding, counting, and storing operations in another separated room of the facility. The decontamination process of the present invention protects the health of the laundry operator and prevent the contaminants from being released into the atmosphere by the process itself. The decontamination process prevents the release of the contaminants into the atmosphere at the time the contaminated reinforced protective clothing is delivered to the facility. The decontamination process also prevents the release of the contaminants by the laundered reinforced protective clothing themselves after they have been laundered. Such release is prevented by the methods and facilities utilized to prevent re-contaminating the reinforced protective clothing after it has been laundered. The decontamination process of the present invention also prevents contaminants from being carried from the interior of the facility by the person conducting the laundering operation.

The decontamination process of the present invention provides for filtering of the laundry waste water to a level that is safe for its disposal through the sewer.

Figure 3:
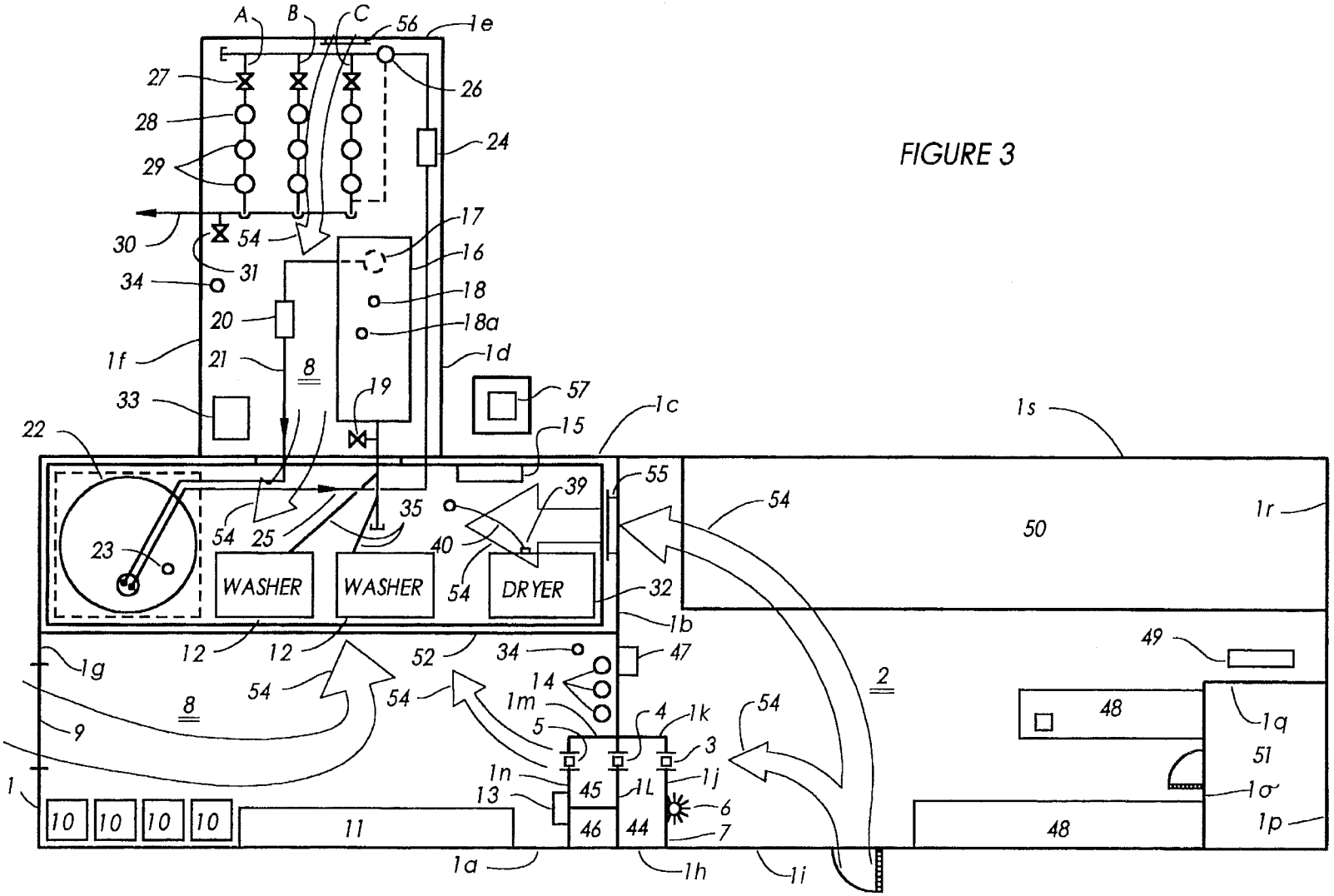
FIG. 3 is a schematic diagram of a floor plan of the overall decontamination process of the present invention and shows washers, dryer, filtration system, settling tank, holding tank, filter banks, pumps, pressure gauges, sensors, controls, piping, clean air in-flow and direction indicated by arrows, and facility areas including the clean clothing, folding, repairing, counting, storage, and office areas.

FIG. 3 is a schematic diagram of the floor plan of the overall decontamination process of the present invention and shows the washers, the dryer, the filtration system, the settling tank, the holding tank, filter banks, pumps, pressure gauges, sensors, controls, and piping. FIG. 3 also shows the clean air in-flow and its direction, indicated by arrows. Also shown is the clean clothing, folding, repairing, counting, storage, and office areas.

Referring now to FIG. 3, area 8 designates the overall containment area and waste water filtration area, and area 2 designates the overall clean clothes, sorting, repairing, folding, storage, and office area.

The containment and filtration area 8 includes outer walls 1, 1*a*, 1*h*, 1*j*, 1*k*, 1*b*, 1*c*, 1*d*, 1*e*, 1*f*, 1*g*, and overhead door 9. Area 8 includes clean room/airlock 44, defined by walls 1*h*, 1*j*, 1*k*, and 1L. Shower room 45, 46 is defined by walls 1*a*, 1L, 1*m*, and 1*n*. Vented solid doors 3, 4, and 5 are provided in walls 1*j*, 1L, and 1*n*. Vents on doors 3, 4, and 5 are positioned so that air drawn in may pass from the outside through clean clothing area 2, through vent 55, and through vents 3, 4, and 5 into clean room/airlock 44, into shower room 45, 46, and into the laundering area, as indicated by arrows 54. Clean, outside air also is drawn in through vent 56 on wall 1*e*. All vents are designed to prevent air from moving from the shower room 45, 46 through clean room/airlock 44 and into the clean clothing area 2. The vents have a flap on the negative pressure side. Arrows 54 indicate the direction of the flow of clean air into the containment area, through the several self-closing flapped vents, and throughout the containment area.

Negative pressure within containment area 8 is maintained at minus 0.02 or less inches of water and is documented by the use of differential pressure documenter 47, which is an instrument used to monitor relative pressure differential. Preferably, differential pressure documenter 47 is provided by a digital pressure manometer connected to a chart recorder for documentation and record keeping. This instrument has both audible and visual alarms with highly visible readout. The alarm is to warn the operator of any possible failure in the negative pressure inside the containment area.

Microprocessor-controlled, programmable washing machines 12 provided in area 8 have drain lines 35 extending to holding tank 16. Sampling outlet 19 is provided for testing the pre-filtering waste water contamination level.

Electrical control panel 13, having indicators and alarms, controls all the electrical functions within the containment area by means of a microprocessor-based programmable controller. A manual override is available to the operator at all times, and the operator can control the process manually in case of any malfunction.

Holding tank 16 has an automatic level control 18 which turns on pump 20 at a preset level. Waste water is pumped out of holding tank 16 via bottom outlet 17 by pump 20 through pipe 21 and into large settling tank 22 which has a top lid. A second, automatic level control 18*a* turns on pump 20 at a preset level as a safety feature. When level control 18*a* is activated, an alarm and a blinking red light turn on in control panel 13, thereby alerting the operator. Heavy particulates are separated, e.g., such as dirt, sand, or lint, and a major portion of entrained contaminants settles down to the bottom of the tank.

After a predetermined time period, as measured by a timer in control panel 13, the contents of the closed top tank 22 are pumped out automatically from a preset level from the bottom of closed top tank 22 by the programmable controller in control panel 13 through pipe 25 by pump 24. Differential pressure sensor/transmitter 26 reads and transmits pumping pressure drop to the programmable controller in control panel 13.

The waste water then is routed automatically through one of three filter banks A, B, or C selected by the programmable controller. The controller opens one bank and closes the next one by operating electrically actuated valve 27A, 27B, or 27C based on a preset pressure differential at the programmable controller in panel 13. Each electrically actuated valve 27A, 27B, or 27C has a red and a green light (not shown). The green light is on when the valve is open. The red light is on when the valve is closed. The programmable controller in panel 13 will sound an alarm if all the valves are closed.

Each filter bank consists of three large filter cartridges, piped in series so as to force the waste water to pass first through a five micron filter 28, then through a one micron filter 29, and finally through a second one micron filter 29. The clean, filtered water then is well below the acceptable level for disposing the contaminated waste water through drain pipe 30 and into the sewer system.

The loaded filters are removed from their housings and back-washed clean by filter back-washing machine 33. Clean filters are installed at the time the loaded filters are removed for cleaning.

Sampling outlet 31 is provided for testing the filtered water downstream of the filtering banks. The fiber count, in MF/L (million fibers/liter) is well below the EPA allowable level for disposal through the sewers, as tested by the accurate and reliable test available by TEM (Transmission Electron Microscopy) and performed by an accredited, AIHA certified laboratory (American Industrial Hygienist Association).

Larger settling tank 22, smaller holding tank 16, and the filter housings have no large surface of contact between the contaminated water and the ambient air, only normal venting for filling and pumping. This absence of surface of contact feature reduces the amount of contaminants entrained with the water vapors which could be carried out through the containment area.

The washing machines 12 and tank 22 are within dike 52 to contain any remotely possible leak. Two vacuum cleaners 34 equipped with HEPA filters are kept at all times within the containment area, one near washing machines 12, the other near pumps 20 and 24.

All the functions of the washing machines 12 are controlled by a built-in microprocessor, including cycles, duration of cycles, amount and temperatures of water, chemical feed from metering pumps 15 and chemical storage containers 14, as well as other features, which provide for the repeatability of the washing results.

All walls shown in FIG. 3 facing the inside of the containment area are finished with smooth, white marlite surfaces to reduce adherence of the contaminants and to facilitate the wash down of walls 1, 1*a*, 1*n*, 1*m*, 1*b*, 1*c*, 1*d*, 1*e*, 1*f*, and 1*g*.

Prior to the start of laundering, the floor in the work area is covered with one layer of 6 mil polyethylene sheeting. At the end of each day, this sheeting is HEPA vacuumed, then rolled up, and disposed as contaminated material. The pickup and delivery system requires that the contaminated reinforced protective clothing be picked up by trained personnel in a facility-owned or licensed, enclosed truck. The reinforced protective clothing is picked up in a condition already packaged inside two six-mil polyethylene marked bags. These bags will have already been decontaminated on the outside surface prior to leaving the pick up area. When picked up, the bags are placed in sealed containers inside the enclosed truck. The box truck is lined with 6 mil polyethylene sheeting on the inside.

At the laundry, the truck is backed all the way into the containment area 8 through overhead door 9. The double bags then are transferred from the truck's sealed containers to the containment area in sealed containers 10. By the described handling system, no contaminants will be released to the atmosphere from pickup to delivery points.

Figure 4:
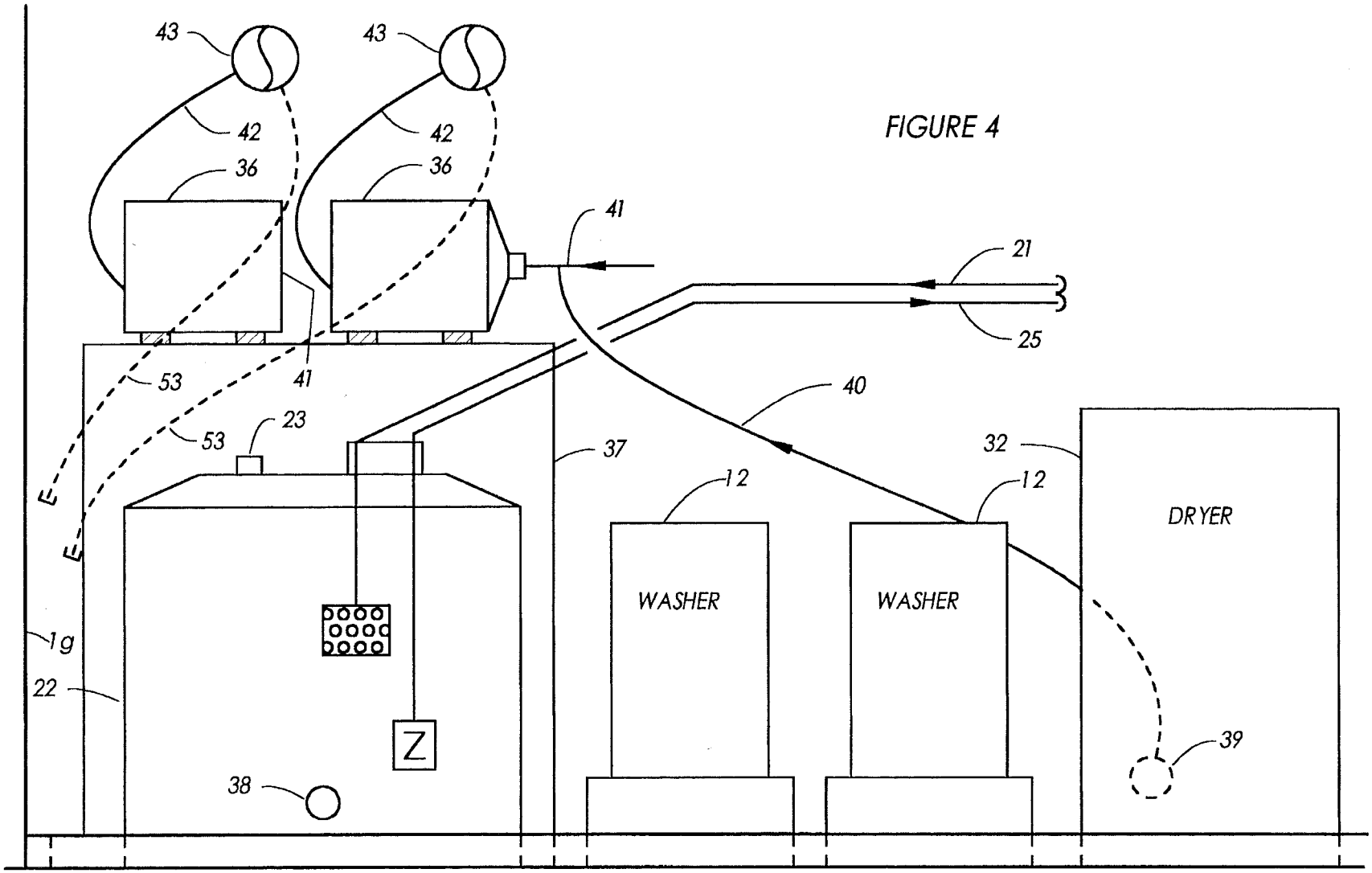
FIG. 4 is an elevation view, partially in section, of the settling tank, its piping, the washers, dryer, and exhaust connection via flexible duct to one of two HEPA air filtration machines set on a platform above the settling tank and exhaust ducts connected to the outdoors in accordance with the present invention.

FIG. 4 provides a sectional view of settling tank 22, its piping, washers 12, dryer 32, and its exhaust connection via flexible duct to one of at least two HEPA air filtration machines 36. In one embodiment, the HEPA air filtration machines 36 are set on a platform above the settling tank 22. The air filtration machines 36 have exhaust ducts 43 connected to the outdoors.

Referring now to FIG. 4, dryer 32 has exhaust 39 directly connected via duct 40 to the intake 41 of one of the two HEPA air filtration machines 36. These HEPA air filtration machines 36 are equipped with high efficiency particulate absolute filters (HEPA) rated and certified to be a minimum 99.97% efficient at 0.3 micron. Additionally, these machines are equipped with two other pre-filters (non-HEPA), automatic controls, and a loud sounding alarm and lights to warn the operator of the status of all the filters. The two HEPA air filtration machines 36 are positioned on platform 37 which stands above settling tank 22. The outlet side of the HEPA air filtration machines 36 are connected by duct 42 to the outdoors at points 43 on wall 1*c*. The air released to the atmosphere through duct 42 is filtered of contaminants as monitored by pre-established, scheduled air testings of samples taken through sampling outlets 53 and analyzed by an AIHA accredited laboratory.

The suction of approximately 3600 cfm (cubic feet per minute) of air from the containment area 8 by HEPA machines 36 creates a negative pressure inside the containment area 8 in relationship to the surrounding areas beyond walls 1, 1*a*, 1*h*, 1*j*, 1*k*, 1*b*, 1*c*, 1*d*, 1*e*, 1*f*, 1*g*, and overhead door 19. The air filtration machines (HEPA) 36 start automatically. HEPA machines 36 turn on at all times (1) when overhead door 9 opens and the delivery truck backs all the way into the containment area 8 or (2) when the laundering process is taking place. Delivery never is permitted when the laundering process is taking place. HEPA machines 36 change the entire volume of air in area 8 at a minimum rate of six times per hour by drawing in fresh, clean air from the outside. Air volume changeover is performed every time laundering is taking place.

The functioning of the HEPA machines 36 and the negative pressure created in containment area 8 provide that air will always flow into the containment area from the clean surrounding areas and never in the opposite direction, further providing that no contaminants will be released to the atmosphere through the surrounding clean areas.

At a preset time period, the bottoms of settling tank 22 are pumped out through outlet 38. The inside of settling tank 22 is pressure washed, and the sludge is disposed according to EPA regulations.

Referring back to FIG. 3, the vents on vented doors 3, 4, and 5 as well as vent 55 on wall 1*b* and vent 56 on wall 1*e* are permanent, one-way, self-closing vents, i.e., with flaps on the negative pressure side of the air stream flowing from the surrounding clean areas into containment area 8 through the vents. This vent system does not require that the operator open or close any vents.

Emergency electrical power generator 57 is provided as a safety measure in case of a failure in the electrical power supply. Should any electrical power failure occur, emergency generator 57, after a pre-established time delay, will automatically turn on, thereby re-establishing all the functions within containment area 8, including the operation of the air filtration HEPA machines.

All laundry removed from dryer 32 is placed into a sealed container, and after all laundry is done and all decontamination procedures have taken place, the laundry in a container is removed through the shower door 5 into shower room 45, 46, where the container is wet wiped. After showering, the operator moves the sealed, wet-wiped container through door 4 into the clean room 44, where the operator dresses in clean street clothes. Then the operator moves the container into clean area 2 through door 3 for sorting, repair, folding, and storage.

The lint from dryer 32 is removed daily from the lint screen. At regular, preset time periods, the lint from dryer 32 is sampled and analyzed for asbestos fiber or other contaminants content by an AIHA accredited laboratory.

Containment area 8 does not require division by a solid wall or any other means between the washer and dryer area because of the dramatic reduction in the amount of the listed contaminants. Listed contaminants released into the containment area 8 are monitored in the air for both the containment area and the operator's breathing area, within the containment area in a TWA (time weighted average) basis, and then are analyzed by an AIHA accredited laboratory.

The reduction in contaminants released into the containment area and the elimination of the need for a wall between the washers and the dryers are attributable to the following features of the present invention:

1. Safe delivery procedures and facilities which provide no contaminants are released into the containment area when dirty reinforced protective clothing bags are transferred into it.

2. Wetting of the reinforced protective clothing prior to pulling out of the double bags.
3. Improved air filtration and flow control system in the containment area, which directs the air flow in a manner that does not allow contaminated air to flow toward the dryer, and the introduction of HEPA filters and other methods and means for constant monitoring of the air in the containment area, the operator's breathing area air, the exhaust air, and the negative pressure introduced in the containment area with respect to the surrounding areas.
4. The protection of the floors in the containment area by placing 6 mil polyethylene sheeting thereon.
5. The introduction of microprocessor-controlled, programmable washers, thereby providing for repeatability of the results. Also, the introduction of testing of the laundered reinforced protective clothing for residual contaminants, providing reliability in the laundering process and its results.
6. The introduction of a smooth wall finish, which substantially reduces adherence of contaminants to the smooth surface, and washing down all surfaces in the containment area after each day laundering is complete, thereby reducing the contamination possibility.
7. The utilization of an enclosed waste water tank and filters, thereby reducing the contact of the hot, contaminated water with the containment area ambient air.
8. The reduction of possible human error in the closing and opening of vents by utilizing self-closing flapped vents. These self-closing flapped vents are strategically placed throughout the containment area to properly direct the flow of the clean air coming into the inside of the area through vents 3, 4, 5, 55, 56, and overhead door 9 when the door is open.

Steps One through Nine further describe the facilities, methods, and procedures of the present invention. In Step One, the operator previously has been trained thoroughly in the operation and the safety features of the decontamination facility of the present invention. The operator turns on red warning light 6, then enters clean room/airlock 44 from clean room 2 through vented door 3. In clean room/airlock 44, the operator changes his or her regular clothing and puts on protective coveralls, gloves, head covering, foot wear, and an OSHA approved respirator equipped with HEPA filters. The operator will also strap to his or her waist a personal air monitoring pump to monitor breathing area air. The floor in area 8 has been previously covered with a layer of 6 mil plastic.

In Step Two, the operator proceeds through vented door 4, through shower room 45, 46, and then through vented door 5 into containment area 8, where he or she proceeds to turn on both HEPA air filtration machines 36 via control panel 13. At this point, if the filters in the air filtration machines are loaded, i.e., need replacing, or if after any other machine malfunction, a loud alarm will sound, red lights will go on at the machines, and no laundering will take place until the cause for the malfunction is repaired.

In Step Three, the high volume pump is turned on for the monitoring of the air in area 8 and also will turn on his or her personal air monitoring pump. The air samples are to be sent to an accredited laboratory for analysis with a next day results turn around requested.

In Step Four, the operator picks up the double-bagged dirty reinforced protective clothing, one bag at a time, from sealed containers 10 and reseals container 10. The operator wets down the dirty clothes by means of an airless spray gun and proceeds to load the washing machine 12.

At pre-established intervals, the operator will take samples from the surface of a pre-established number of dirty clothing, prior to wetting them. This is done following an accepted, established procedure. The operator will also mark, with threads, the areas the samples were lifted from. Then he or she will proceed to launder those clothing together with the rest. The sample will be tested by an accredited laboratory.

In Step Five, the operator turns on the microprocessor-controlled, programmable machine 12 which proceeds automatically to launder the dirty clothing. The operator selects a program, which has been programmed in the machine and which is based upon the composition of the clothing and the type of contaminant. The operator must only look up a chart and push in a numerical button indicated on the chart.

In Step Six, the dirty waste water is drained automatically from washing machine 12 into holding tank 16 from which it is automatically pumped into settling tank 22 by pump 20. After a preset time period, it is pumped out of settling tank 22 by pump 24 to the filters 28, 29, and to the sewers through drain pipe 30, as previously described in detail.

On a pre-established schedule, samples of the waste water are taken downstream from the filters and labeled, all in accordance with established procedures. The samples are to be sent immediately to an accredited laboratory for testing and a report.

In Step Seven, after laundering is complete, the operator removes the still wet clothes from washers 12 and places them in dryer 32 where they are dried.

In Step Eight, the dried clothing then is placed in a sealed, wheeled container and moved through vented door 5 into shower room 45, 46, where the operator wet wipes the wheeled container, then strips off the protective clothing, and places them in a sealed container in the shower room. The operator then proceeds to take a shower and to wash clean the respirator. The respirator cartridges are disposed at this point. The personal monitoring pump has been turned off and is also wet wiped.

On a pre-established schedule and procedure, samples are taken from the laundered reinforced protective clothing surface of the clothing tested in Step Four to determine contaminated contents. The testings are to be made by an accredited laboratory.

In Step Nine, the operator then moves the wheeled container through vented door 4 into clean room/air lock 44 where he or she dresses in regular clothing and hangs up the respirator and the personal pump, then moves the wheeled container through vented door 3 into clean room 2 for sorting, repair, folding, and storage.

Thus, it can be seen that a novel decontamination process is provided for laundering asbestos and/or lead, silica dust, titanium dioxide dust, or carbon dust contaminated reinforced protective clothing, for decontaminating the reinforced protective clothing in a manner which provides for the safety of, and protects the health of, the laundry operator, and for preventing asbestos and/or lead, silica dust, titanium dioxide dust, or carbon dust contamination to the atmosphere from the laundry.

Facilities and methods are provided for laundering contaminated reinforced protective clothing in an environmentally controlled area, monitored and controlled for air pressure, air flow pattern and volume, and fully sealed-in in respect to waste water. If any of the contaminants remain on the laundered clothes, the amount is insignificant levels or at the most within the maximum allowed.

Facilities and methods are also provided for a controlled environment enclosure defining a washer, dryer, and waste water settling and filtering side without walls between them. The fully contained laundering area without walls between washer and dryer areas in accordance with the present invention does not recontaminate the reinforced protective clothing after laundering it.

A clean room/air lock communicates with the washer/dryer filtering side and two solid doors with flapped vents-air inlets. One vented door communicates with the large clean room used for sorting, repair, folding, and storage of laundered reinforced protective clothing. The other vented door communicates with the shower room. The vents permit air to flow only toward the shower room and beyond, but not in the opposite direction.

A shower room has a solid door with a flapped vent (air inlet) door communicating with the washer/dryer/filtering side. The flapped vent permits the air to flow only toward the washer, dryer area and not in the opposite direction.

A one-way venting (air inlets) system with flaps allows the flow of air only in one direction from the surrounding clean areas and from the clean room used for sorting, repair, folding, and storage through the clean room airlock, through the shower room, and into the washer/dryer/filtering side. System operation does not require the operator's full attention. Rather, the venting system of the present invention utilizes self-closing air inlet flaps.

The microprocessor-controlled, programmable washers and dryer provide repeatability of the laundering parameters in the washer/dryer/waste water settling and filtering side.

An asbestos and/or lead, silica dust, titanium dioxide dust, or carbon dust contaminated water filtering and disposal means associated with the programmable washers operates automatically and has fail-safe features. The filtering means will filter the waste water down to a contaminant content per liter acceptable for disposal through the sewer.

At least two air filtering machines equipped with HEPA filters create and maintain a negative pressure within the washer/dryer/waste water settling and filtering area. The negative pressure is maintained through flapped vents on walls 1*b* and 1*e*, through flapped vents on solid doors in the clean room/air lock and the shower room, and through overhead door 9 (when the door opens for letting the enclosed/inside-lined truck back up all the way into the washer/dryer/filtering area).

A monitor and alarm means will warn the operator of any failure in the level of negative pressure within the work area.

The HEPA air filtering machines are used for the direct filtering of the containment area air and of the dryer exhaust air before it is exhausted to the surrounding atmosphere.

An emergency auxiliary generator provides power for emergency functioning of the air filtration HEPA system and other elements of the facilities and process of the present invention. The purpose is to protect the health and safety of the laundry operator. The purpose also is to protect the surrounding environment.

A series of alarms, warnings, audible and visible signals, and redundant tank level controls provide for operator safety and environmental protection.

The health of the operator and the protection of the environment are provided by pre-established scheduled sampling of the operator's breathing air area, the overall work area air, the air filtration HEPA machines exhaust air, the dryer exhaust air, the dryer lint, the contaminated reinforced protective clothing prior to and after laundering, and the filtered waste water. Testing of all of the above samples is to be performed only by an independent AIHA accredited laboratory.

An overhead door between the outside and the washer/dryer/filtering side opens up only when no laundering is taking place. The door allows dirty clothing in double bags to be transferred from sealed containers from an enclosed truck into sealable containers inside the washer/dryer/filtering area and only while the area is under negative pressure to force air to flow only in one direction through the overhead door and other clean areas and into the washer/dryer/filter area.

A clean room area is used for sorting, counting, repair, folding, and storage of the laundered reinforced protective clothing. The clean room communicates with the clean room/air lock through the solid door with flapped vent, allowing air to flow only from the clean room to the clean room/air lock and not in the opposite direction.

The present invention provides a decontamination process for decontaminating various types of woven and non-woven fabric, permeable and impermeable reinforced protective clothing.

Figure 5:
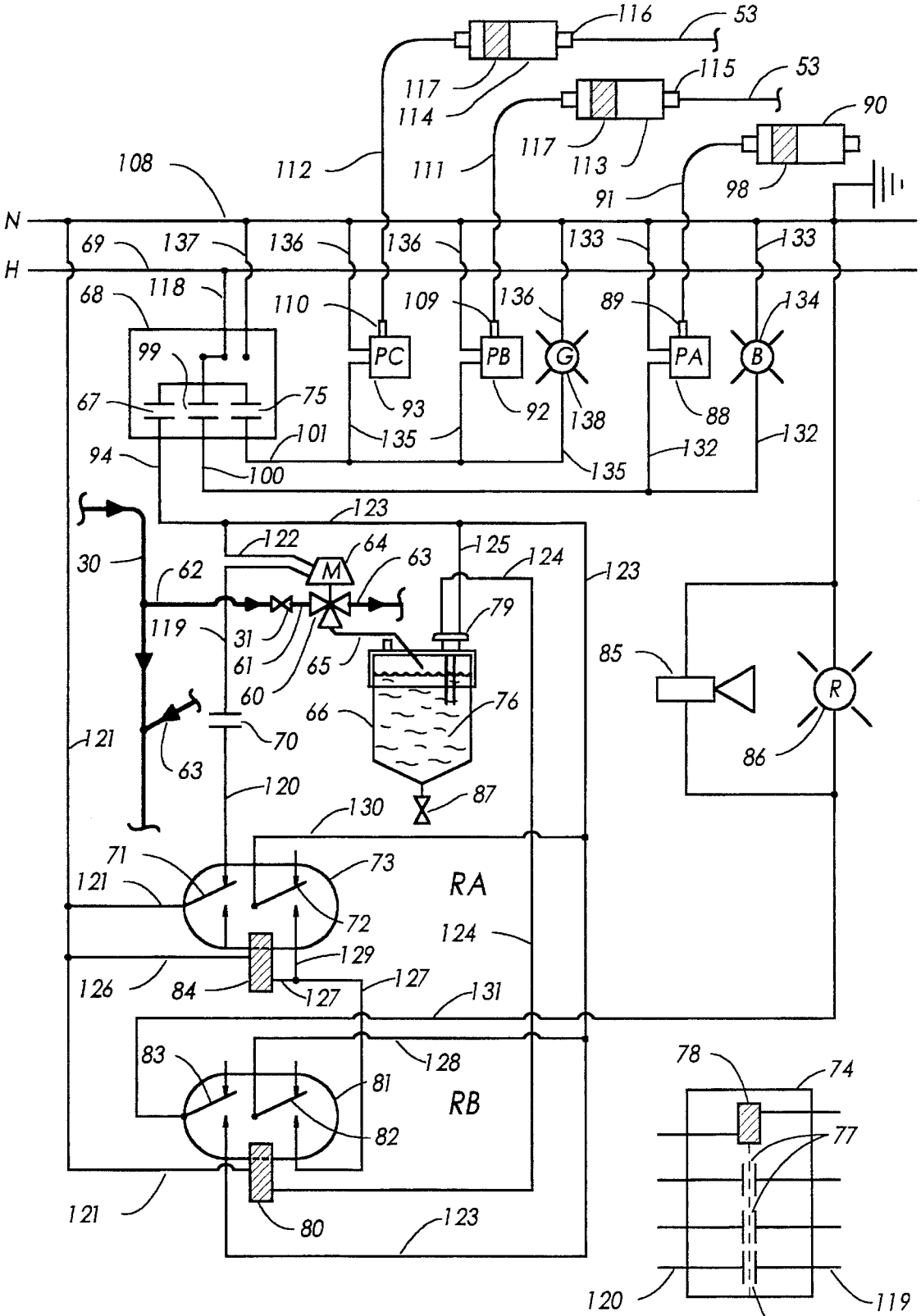
FIG. 5 is an electrical schematic diagram showing electrical components, pictographically and symbolically, and electrical wiring of the sampling system in accordance with the present invention.
Figure 12:
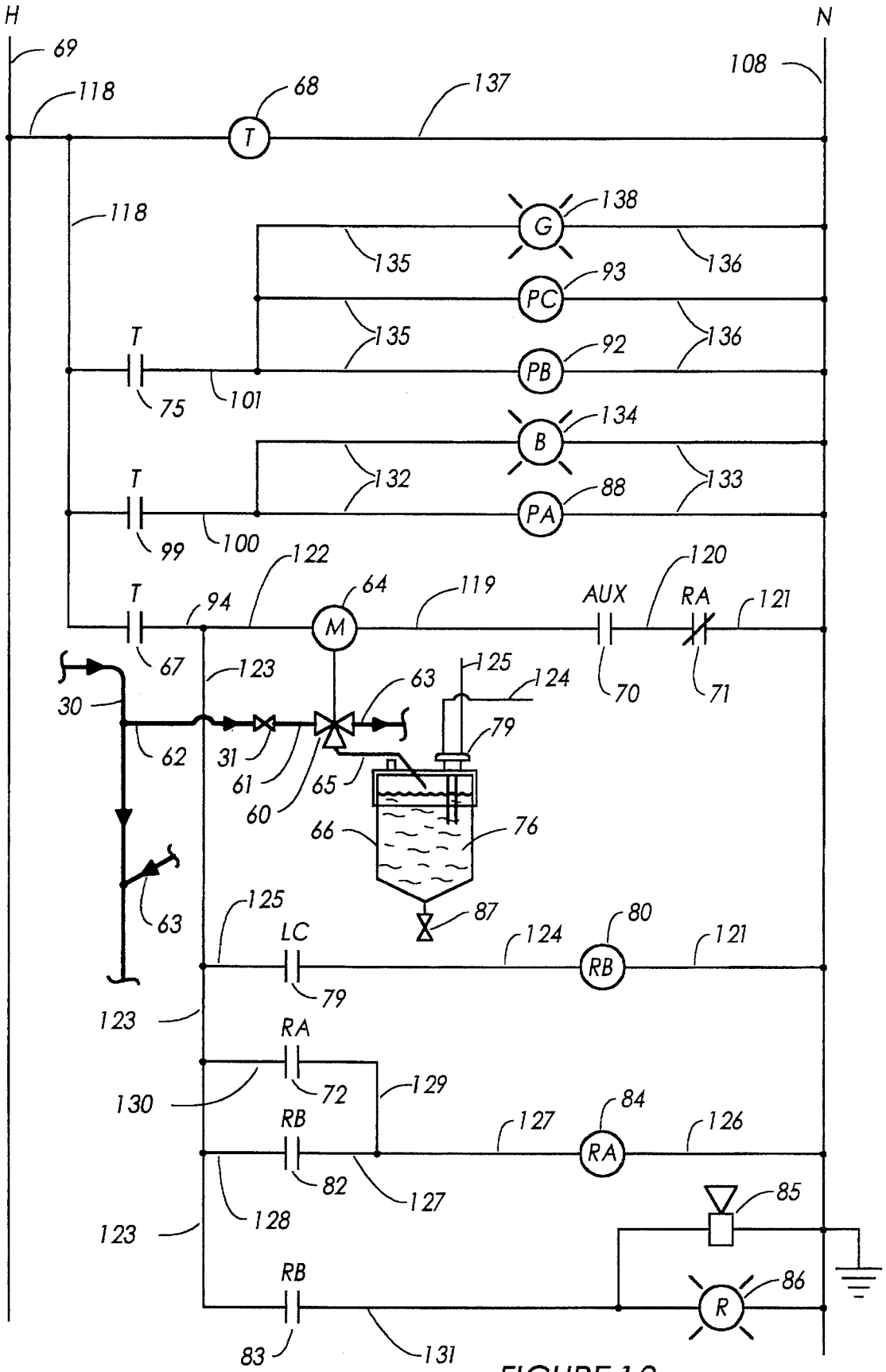
FIG. 12 is an electric ladder diagram showing electrical components and electrical wiring of the sampling system of the present invention.

FIG. 5 is an electrical schematic diagram, and FIG. 12 is an electric ladder diagram, both showing the electrical components, pictographically and some symbolically, and the electrical wiring of the entire sampling system. FIG. 5 and FIG. 12 also show an electronic liquid level control device installed on a sample receiving container, a three-channel programmable, electronic timer and its three independent contacts, three high volume air pumps, three sampling cassettes, three blinking lights of diverse colors, electrically operated relays, and a horn. A partial piping schematic diagram shows the pipes for the waste water samples to flow through, with the direction of the flow indicated by arrows, and three valves, including a tri-way, motorized valve.

Referring now to FIGS. 5 and 12, novel methods and means are provided in accordance with the present invention for the automatic timing of the waste water sampling, exhaust air sampling, and containment area air sampling. Timing of the sampling refers to the date and time of day in which the taking of a sample is scheduled to begin, the duration of the timing cycle, and the utilization of timer contacts to close and to open various electrical circuits connected to those contacts for the purpose of energizing the components of the sampling system.

Timer 68 provided in the preferred embodiment of the present invention is a three-or-more-channel, microprocessor-based, digital controller, hereinafter called microprocessor-based, digital controller or timer 68. Each channel is independently programmable with 40 on/off operations per week or more and switches on/off its own set of contacts rated at 10 amperes, 120 or 240 volts, but not necessarily limited to such rating.

Microprocessor-based, digital controller 68 provides 365 day programming in advance with 40 holiday dates or more and 8th day holiday schedule and also with 8 season blocks or more of unlimited duration, each capable of a different schedule.

Each channel in microprocessor-based, digital controller 68 has approximately 0–255 minutes remote manual time override, which is adjustable. It also has AM/PM, i.e., ante meridian/post meridian, or 24-hour military time, user selectable, automatic daylight savings or standard time, leap year, automatic adjustment, a plain English self-prompting display, and a battery backup with at least a 6 month cumulative reserve and a 10 year shelf life.

Contacts 67 of microprocessor-based, digital controller 68 are utilized for controlling the waste water sampling. Contacts 75 are utilized for controlling the exhaust air sampling, and contacts 99 are utilized for controlling the containment area air sampling.

In the description of the sampling system of the present invention, each of three major sub-systems are detailed. The first sub-system is sampling the cleaning fluid discharge, i.e., waste water from filter banks A, B, and C. The second sub-system is sampling the exhaust air from HEPA filtration machines 36. This is the air from the washer/dryer area 8 and the cleaning fluid filtering area 8 after the air has been filtered. The third sub-system is sampling the air from the same areas just mentioned, but prior to being filtered, also known as work area sampling.

First the sampling methods and apparatus of the present invention are described as applied to automatically sampling the cleaning fluid filtering area waste water discharge.

Motorized, tri-way valve 60 has its normally-open outlet 63 piped to waste water discharge pipe 30, which allows a portion of waste water to flow through valve 60 and back into discharge pipe 30 every time pump 24 pumps waste water through any one of filter banks A, B, or C. By allowing waste water to flow through one side of the sampling system when the system is not sampling, the possibility of sampling a portion of previously sampled waste water is substantially eliminated. The amount of waste water flowing through pipe 62, valve 31, pipe/inlet 61, tri-way valve 60 and pipe 63, or outlet 65 is always representative of the waste water to be sampled at any given sampling cycle.

Motorized tri-way valve 60 has normally closed outlet 65 piped into container 66 to allow the flow of waste water into container 66 only when motor-actuator 64 closes normally open outlet 63 and opens normally closed outlet 65.

An electrical circuit energizing motor-actuator 64 is completed via wires 122 and 94 through contacts 67 in microprocessor-based, digital controller 68 and via wire 118 to hot wire 69 of power lines 69, 108. The electrical circuit energizing motor actuator 64 is finally complete to the neutral wire 108 of power lines 69, 108 via wire 119 through normally open auxiliary contacts 70 of motor starter 74 of pump 24 and further through wire 120, normally closed contacts 71 of relay RA 73, and finally through wire 121 to the neutral wire 108 of power lines 69, 108.

Figure 6:
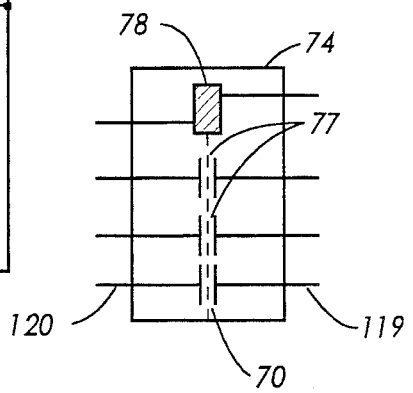
FIG. 6 is an electrical schematic diagram, partially representing the basic components of a motor starter in accordance with the present invention, and showing its electrically operated coil and several sets of contacts, one of which is an auxiliary set of contacts.

FIG. 6 is an electrical schematic diagram, partially representing the basic components of a motor starter, showing its electrically operated coil and several sets of contacts of which one is an auxiliary set of contacts.

Referring to FIG. 6, normally open contacts 77 in motor starter 74 close to start pump 21. A timer in control panel 13 energizes coil 78 in pump starter 74. Coil 78 in motor starter 74 when energized forces normally open contacts 77 to close, making pump 24 run. Coil 78 also forces normally open auxiliary contacts 70 to close, allowing the waste sampling to take place.

When normally open auxiliary contacts 70 in pump motor starter 74 close, the electrical circuit to energize motor actuator 64 is complete, and it energizes valve 60. This closes valve 60, normally open outlet 63, and opens normally-closed outlet 65, which allows waste water to flow into container 66.

When sample container 66 fills with waste water sample 76 to a pre-established level, electronic level control 79 will allow its internal, electronic control circuitry to close the electrical circuit of coil 80 of relay RB 81 via wire 124 through coil 80, via wire 121 to the neutral wire 108 of power lines 69, 108, and finally via wires 125, 123, and 94 through contacts 67, in microprocessor-based, digital controller 68 and via wire 118 to the hot wire 69 of power lines 69, 108. Relay RB 81 has two sets of normally open contacts 82 and 83. These contacts 82 and 83 close simultaneously when coil 80 is energized.

When normally open contacts 82 of relay RB 81 close, coil 84 in relay RA 73 is energized. This is accomplished on one side of coil 84 via wire 126 to the neutral wire 108 of power lines 69 and 108, on the other side of coil 84 via wire 127, through normally open contacts 82 of relay RB 81, and via wires 128, 123 and 94, through normally open contacts 67 of microprocessor-based, digital controller 68 and finally via wire 118 to the hot wire 69 of power lines 69, 108.

Coil 84 of relay RA 73, when energized by relay RB 81, opens normally-closed contacts 71 and closes normally open contacts 72, which creates a second energizing, electrical circuit, referred to herein as sealing circuit, via wire 127 and 129, through contacts 72, via wires 130, 123, and 94, through normally open contacts 67 of microprocessor-based, digital controller 68 and finally via wire 118 to the hot wire 69 of power lines 69, 108.

The second energizing, electrical sealing circuit maintains coil 84 of relay RA 73 energized even after water sample 76 is removed from container 66. Removing water sample 76 from container 66 will de-energize coil 80 of relay RB 81. This returns normally open contacts 82 to the open position, which will open the first circuit which energized coil 84 of relay RA 73. Nevertheless, the second energizing circuit or sealing circuit keeps coil 84 energized for as long as contacts 67 of microprocessor-based, digital controller 68 remain closed, which keeps open, i.e., electrically disconnected, the energizing circuit of motor actuator 64. Because contacts 71 and 72 of relay RA 73 move simultaneously when coil 84 is energized, it pulls open normally closed contacts 71 of relay RA 73, thereby de-energizing motor actuator 64, which closes outlet 65 and opens outlet 63, both of valve 60, thereby stopping the flow of waste water into sample container 66. Motor actuator 64 when de-energized through internal control circuitry reverses motor polarity to turn its motor in the opposite direction, thereby returning valve 60 to its original position, the position prior to motor actuator 64 being energized, i.e., normally closed outlet closed and normally open outlet open.

Electronic level control 79 stops the flow of waste water into sample container 66 by disconnecting motor actuator 64 from its electrical circuit by opening normally closed contacts 71 in relay RA 73 and also provides a second electrical circuit, sealing circuit, that maintains coil 84 of relay RA 73 energized through its own contacts 72, even after removing waste water sample 76 from sample container 66. This provides that motor actuator 64 stays disconnected after water sample 76 is removed from sample container 66.

The need for disconnecting motor actuator 64 from its electrical circuit after the waste water sample is removed arises from the fact its electrical circuit is completed through auxiliary contacts 70 in pump motor starter 74. If motor actuator 64 were not automatically disconnected from its electrical circuit after waste water sample 76 was taken, a new sample would flow into sample container 66 every time pump 24 starts pumping because contacts 67 of microprocessor-based, digital controller 68 are programmed to stay closed for a certain time period. In that time period, pump 24 could still be pumping or could be made to run if required by the laundry operator.

At the programmed date and time, microprocessor-based, digital controller 68 closes its contacts 67. Microprocessor-based, digital controller 68 is programmed to keep its contacts 67 closed for a period of approximately two hours to allow pump 24 to run at least once at the programmed sampling date. Any other length of time can be programmed alternatively. If for any reason pump 24 runs for a short time period and waste water sample 76 does not reach the pre-established level, level control 79 will not energize relay RB 81, and waste water will flow into sample container 66 automatically the next time pump 24 runs again, within the approximately two hours above mentioned, until waste water sample 76 reaches the pre-established level. Nevertheless, the time of the day and the duration of the time period pump 24 pumps waste water are predetermined. By the methods and apparatus of the present invention, the timers can be programmed to take the waste water sample at the desired date, and the timers can also be programmed for the starting time on that day to be, for instance, fifteen minutes prior to the starting time for pump 24 and keep the timer contacts "on" for one hour or any other desired time period.

When the time period terminates for the time contacts are kept "on" for contacts 67 if microprocessor-based, digital controller 68, i.e., when contacts are closed, the timer will open its contacts and will automatically de-energize relay RA 73, making its normally-closed contacts 71 to close. This automatically resets the system, making it ready to take a new sample at the programmed date and time. An alarm is provided to alert a laundry operator that a waste water sample has been taken. It works as follows.

When a sample has been taken, i.e., when waste water sample 76 reaches the predetermined level in container 66, level control 79 energizes coil 80 of relay RB 81, which pulls "closed" its normally open contacts 82 and 83. Contacts 83 in relay RB 81 complete the electrical circuit of alarm horn 85 or other sounding type of alarm via wire 131, contacts 83, wires 123, and 94 through timer contacts 67, and via wire 118 to hot wire 69 of power lines 69 and 108. Contacts 83 also close the electrical circuit of blinking light 86 in the same manner. Alarm horn 85 and blinking light 86 alert the laundry operator of the fact a waste water sample has been taken and should be removed. Valve 87 at the bottom of sample container 66 is provided for the easy and quick removal of the waste water sample. The sample container 66 is washed clean by the laundry operator each time a sample is removed from it.

In describing now the air sampling portion of the present invention, in one aspect, the air sampling provides for taking samples of the contaminants contained in the air within the containment area, i.e., washer/dryer area 8 cleaning fluid filtering area 8. It also provides for taking samples of the contaminants contained in the exhaust air, i.e., the air being expelled out to the outdoors surrounding environment after it has been filtered through the HEPA (High Efficiency Particulate Absolute) filtration machines 36.

The sampling of the air from containment area 8 is generally done every work day, i.e., everyday the laundering decontamination process operates. The sampling of the exhaust air is generally done two times per month. This less frequent sampling requirement for the exhaust air is because this air is filtered by HEPA machines 36 prior to being expelled out to the outdoors. These machines are manufactured with controls and alarms to alert the operator when the filters are close to being loaded, i.e., require replacing with new filters.

Figure 7:
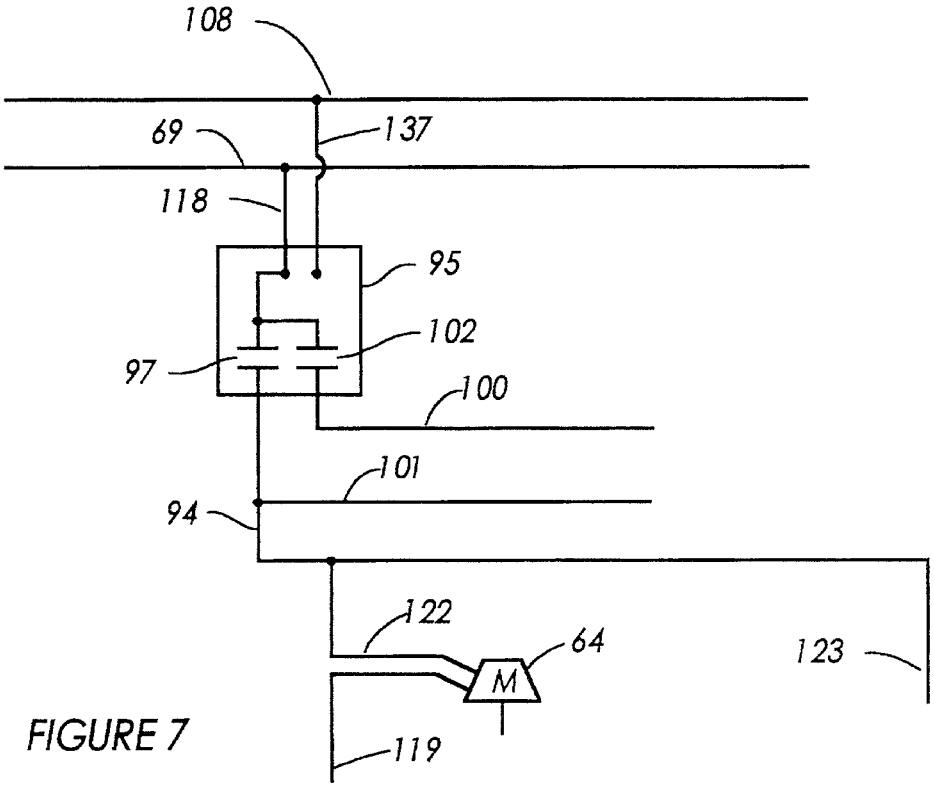
FIG. 7 is an electrical schematic diagram, partially showing the electrical wiring of a two-channel programmable, electronic timer and two sets of contacts in accordance with the present invention.

FIG. 7 is an electrical schematic diagram, partially showing the electrical wiring of a two-channel microprocessor-based programmable, digital controller and two sets of contacts in accordance with the present invention.

Referring now to FIG. 7, the present invention also provides means and method utilizing a two-channel timer 95 instead of a three-or-more-channel microprocessor-based, digital controller 68, provided each of the two channels of two-channel timer 95 is independently programmable and with substantially the same channel capabilities described above.

Because of the close similarity in the sampling frequencies, i.e., how often samples are taken between the waste water and the exhaust air, the timer utilized could be a two-channel timer 95 by utilizing one of its two channels for controlling both the waste water sampling as well as the exhaust air sampling. This is accomplished by electrically connecting wire 94 and wire 101 to contacts 97, which are controlled by one of the two channels, while connecting wire 100 to contacts 102 which are controlled by the second channel of two-channel timer 95.

Contacts 97 control simultaneously the sampling of both the waste water and the exhaust air from HEPA machines 36. The remaining contacts 102 of two-channel timer 95 control the air sampling from the containment area 8.

In this embodiment for those cases where the number of samples per month are different, i.e., one waste water sample per month versus two exhaust air samples per month, some additional, not required waste water samples are taken. This amounts to approximately one to three additional waste water samples if the laundry operates only one shift per workday, which is generally the case. In such a situation, the operator can easily and quickly return the unwanted waste water samples to holding tank 16. The operator is alerted to the fact a waste water sample has been taken by the sound of horn 85 and by the blinking of light 86.

Figure 8:
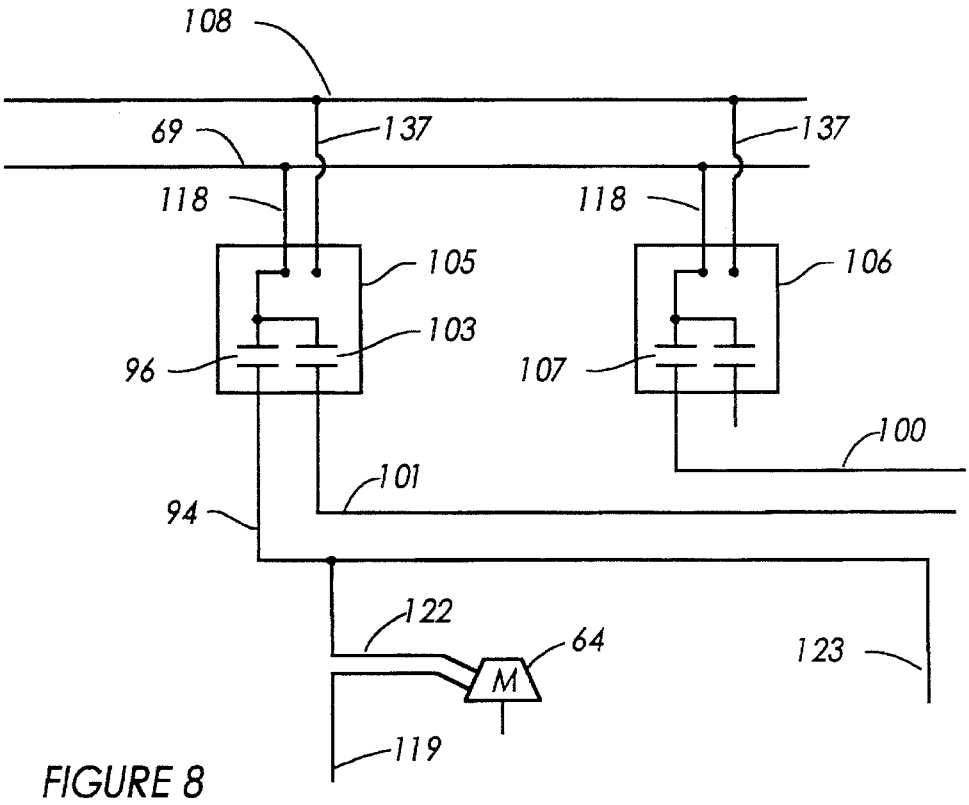
FIG. 8 is an electrical schematic diagram, partially showing the electrical wiring of two separate two-channel programmable, electronic timers and their respective contacts in accordance with the present invention.

FIG. 8 is an electrical schematic diagram, partially showing the electrical wiring of two separate two-channel programmable, electronic timers and their respective contacts in accordance with the present invention.

Referring to FIG. 8, another aspect provided by the present invention is to utilize two separate, two-channel timers 105, 106. Each channel on timers 105 and 106 is independently programmable, and substantially the same channel capabilities are provided for the above-described three-or-more-channel microprocessor-based, digital controller 68.

In the two timer 105 and 106 arrangement, electrical wire 94 is connected to contacts 96 of two-channel timer 105 for controlling the waste water sampling, while wire 101 is connected to the remaining contacts 103 of the two-channel timer 105 for controlling the exhaust air sampling. Remaining wire 100 is connected to contacts 107 of the second two-channel timer 106 for controlling the containment area 8 air sampling. Timer 106 then has one spare channel not utilized.

The three major sub-systems and the description of the preferred embodiment in respect to the timing/controlling apparatus, i.e., the three-channel timer 68, also applies if a two-channel timer 95, or two separate two-channel timers 105 and 106 are utilized, instead of a three channel microprocessor-based, digital controller 68.

If a two-channel timer 95 is utilized instead of three-channel microprocessor-based, digital controller 68, wire 94 is electrically connected to contacts 97 of timer 95 together with wire 101.

If two separate two-channel timers 105, 106 are utilized instead of a three-channel timer 68, wire 94 is electrically connected to contacts 96 of two-channel timer 105. Then wire 101 is electrically connected to contacts 103 of timer 105, while wire 100 is electrically connected to contacts 107 of the other two-channel timer 106.

At the programmed date and time, normally open contacts 67 in one of the channels in timer 68, normally open contacts 97 in timer 95, or normally open contacts 96 in timer 105 will close the electrical circuit connecting motor actuator 64 to power lines 69 and 108. Nevertheless, motor actuator 64 cannot operate valve 60 until normally open auxiliary contacts 70 in motor starter 74 close. Auxiliary contacts 70 close each time motor starter 74 starts pump 24. Motor actuator 64 will not operate valve 60 unless pump 24 is running, i.e., energized. Motor actuator 64 is self-reversing, It will return tri-way 60 to its original position when motor actuator 64 is de-energized.

At the programmed date, i.e., once a month, twice a month, and others, normally open contacts 67 (or normally open contacts 97 for timer 95 or normally open contacts 96 for timer 105) will close, and this will start the sampling cycle. Motor actuator 64 will operate motorized valve 60 when pump 24 starts pumping. Motorized valve 60 will then close its normally open outlet 63 and open its normally closed outlet 65, which will allow waste water sample 76 to fill sample container 66 to a pre-established level. This level is controlled by electronic level control 79. Motor actuator 64 will operate motorized valve 60 only when Pump 24 starts running, i.e., pumping waste water.

Figure 9:
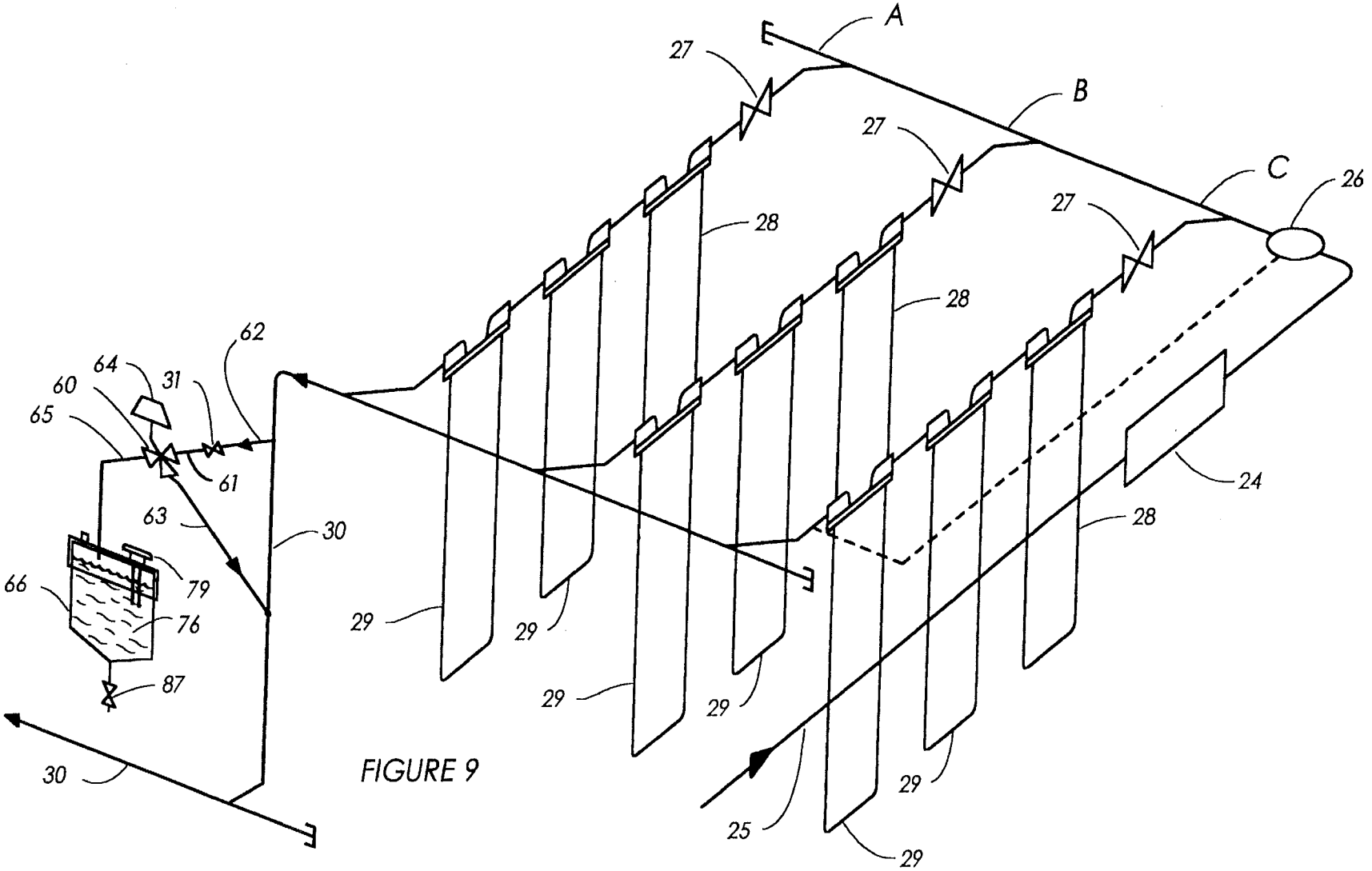
FIG. 9 is a partial schematic diagram showing an electrically operated water pump, three filter banks, and respective filter cartridge containers in accordance with the present invention.

FIG. 9 is a partial schematic diagram showing an electrically operated water pump, three filter banks and their respective filter cartridge containers and partially showing, also schematically, the piping for a waste water sample to flow through, with the direction of the waste water flow indicated by arrows, valves including a tri-way motorized valve, and a container to receive a waste water sample. FIG. 9 also shows an electronic level control device installed on the container.

Motorized, tri-way valve 60 has its inlet side 61 piped through valve 31 from pipe 62 from waste water discharge pipe 30, which is the pipe that carries waste water from filter banks A, B, and C, as shown in FIG. 9.

Figures 10, 11:
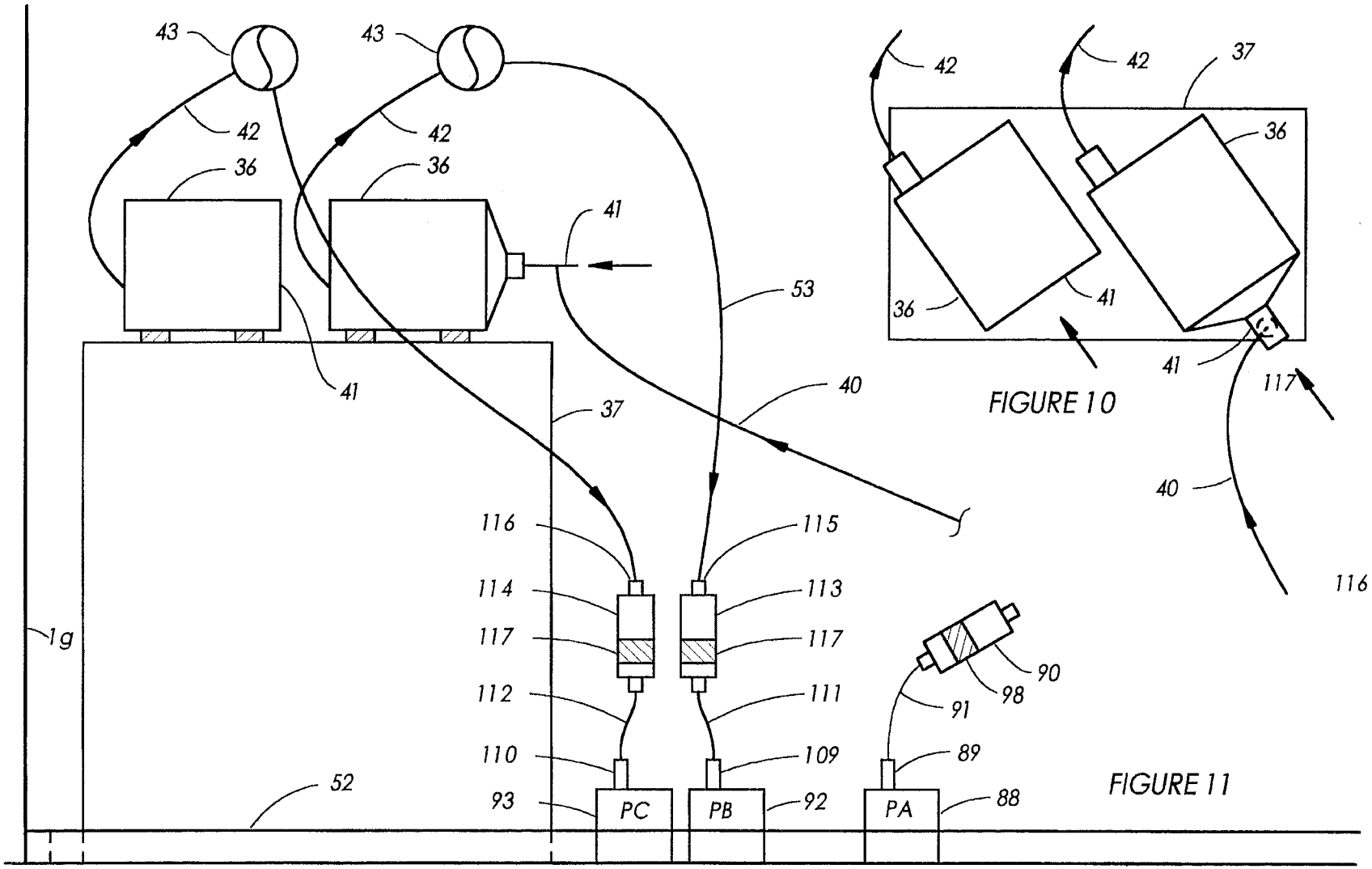
FIG. 10 is an elevation view, partially in section, of two HEPA filtration machines with respective exhaust ducts, three high volume air pumps connected to respective cassettes, and plastic tubing connecting some cassettes to exhaust ducts in accordance with the present invention.
FIG. 11 is a plan view showing two HEPA filtration machines, air flow into their inlets indicated by straight arrows, and connection to respective exhaust ducts in accordance with the present invention.

FIG. 10 is an elevation view, partially in section of two HEPA filtration machines with their respective exhaust ducts. In addition, it shows three high volume air pumps connected to their respective cassettes and plastic tubing connecting some of the cassettes to their respective exhaust ducts. The exhaust air is the air drawn into the washer/dryer area 8 and cleaning fluid filtering area 8, and then filtered by the HEPA filtration machines 36, prior to exhausting it out of these areas into the outdoors environment.

High volume pump 88 is utilized for sampling the air from areas 8. High volume pumps 92, 93 are utilized for sampling the exhaust air from HEPA machines 36.

In further describing the sampling of the air from the containment area 8, high volume air pump 88 is electrically connected via wires 132 and 100 through normally open contacts 99 of timer 68 (or normally open contacts 102 of timer 95 or normally open contacts 107 if timer 106) and via wire 118 to the hot wire 69 of power lines 69, 108. On the other side, pump 88 is electrically connected via wire 133 to the neutral wire 108 of power lines 69, 108.

The air from the containment areas 8, generally referred to as air from the work areas, is the air drawn by HEPA machines 36 into these areas and prior to being filtered by HEPA machines 36.

The channel in microprocessor-based, digital controller 68 (or in timer 95 or in timer 106) that controls the respective set of contacts, i.e., contacts 99, 102, or 107 are programmed to close those contacts, thereby closing the energizing circuit of pump 88, for instance, once every work day at the beginning of the work day, and to keep it energized, for example, for eight hours. Generally, containment area samples are taken for the entire length of the work day, i.e., seven, eight hours, etc.

At the programmed date and time, microprocessor-based, digital controller 68 (or 95 or 106) energizes high volume air pump 88. High volume air pump 88 has its inlet 89 connected via plastic tubing 91 to a specialized, sample retaining cassette 90. Sample retaining cassette 90 is provided with a membrane filter which allows an air stream flow through it. The air stream is drawn by high volume air sampling pump 88. Contaminant fibers or particulate contained in the air stream are retained by the membrane filter as the air flows through the membrane. Sample retaining cassettes 90 are then utilized for analysis, generally by PCM (Phase Contrast Microscopy). The analysis reveals the level of contamination in the areas sampled. This level is then compared to the permissible level for that contaminant, in accordance to OSHA, EPA, and local regulations. At the end of every work day, the operator removes cassette 90 from pump 88 and installs a new one. The operator writes the date, pump flow rate and, sampling time duration, i.e., seven hours, eight hours, etc. on label 98, which is then affixed to cassette 90.

Blinking light 134 being wired, i.e., electrically connected, in parallel to air pump 88 will be turned "on" and start blinking when air pump 88 is energized. It will stop blinking and will be turned "off" when pump 88 is de-energized.

Two high volume air sampling pumps 92 and 93 are utilized. The exhaust air is the air filtered by the HEPA machines 36. High volume air pumps 92 and 93 are electrically connected via wires 135 and 101 through normally open contacts 75 of microprocessor-based, digital controller 68 (or contacts 97 if timer 95 or contacts 103 if timer 105) and via wire 118 to the hot wire 69 of power lines 69 and 108. On the other side, pumps 92 and 93 are electrically connected via wires 136 to the neutral wire 108 of power lines 69 and 108.

The channel that controls the normally open contacts is programmed to close the energizing circuit of high volume air pumps 92 and 93 at the beginning of the work day, once, twice a month, etc. and generally to keep these pumps energized for the entire work day if required.

At the programmed date and time, microprocessor-based, digital controller 68 (or 95 or 106) energizes high volume pumps 92 and 93. High volume air pumps 92, 93 have respective inlets 109, 110 connected via respective plastic tubing 111 and 112 to their respective sample retaining cassettes 113 and 114. Inlets 115 and 116 of sample retaining cassettes 113 and 114 are connected via plastic tubing 53 to exhaust ducts 43 from their respective HEPA filtration machines 36.

Blinking light 138, being wired, i.e., electrically connected in parallel to air pumps 92 and 93 will be turned "on" and will start blinking when air pumps 92 and 93 are energized and will stop blinking and will be turned "off" when pumps 92 and 93 are de-energized. Sample retaining cassettes 113 and 114 are each provided with a membrane filter capable of collecting on it contaminant fiber or particulate entrained in an air stream drawn through the respective membrane filter by high volume air pumps 92 and 93.

These sample retaining cassettes are then utilized for laboratory analysis, generally by PCM (Phase Contrast Microscopy). The results of such analysis reveal whether the air stream has been freed of contaminants by the HEPA filtration machines as required by EPA (Environmental Protection Agency) and other local agencies regulations.

After the samples are taken, the operator removes cassettes 113 and 114 and installs new ones. The operator writes the date, pump flow rate, and sampling time duration, e.g., in hours, on respective labels 117, which are then affixed to sampling cassettes 113 and 114 for the next sampling cycle.

FIG. 11 is a plan view showing the two HEPA filtration machines 36, the air flow into their inlets, indicated by straight arrows and their connection to their respective exhaust ducts.

By the present invention, automatic sampling methods and apparatus are provided for automatically taking cleaning fluid discharge samples, i.e., waste water samples, and for automatically taking exhaust air samples and containment area air samples at any predetermined frequency, i.e., once or more times a month, once a week, daily, and others. The waste water samples are taken from the discharge side of the filter banks. The exhaust air samples are taken from the discharge side of the HEPA air filtration machines. The containment area air samples are taken from the washer/dryer area, the cleaning fluid filtering area. Waste water samples are taken in a container which has a removable lid and an electronic level control device. Exhaust air samples and containment area air samples are taken through specialized cassettes which contain a polycarbonate or a mixed cellulose membrane filter used to collect fibers/particulate of the contaminant for laboratory analysis.

When a sample is taken, the operator is alerted by a sounding alarm or a blinking light or a combination of both. After the samples are removed from the system, they are submitted for laboratory analysis. The waste water samples are analyzed by T. E. M. (Transmission Electron Microscopy) analysis and the air samples (cassettes) by P. C. M. (Phase Contrast Microscopy) analysis. After a sample is taken, the automatic sampling system resets itself and is then ready for the next sampling cycle. The present invention provides additional advantages of an improved decontamination process for laundering reinforced protective clothing contaminated with asbestos fibers and/or lead, silica dust, titanium dioxide dust, or carbon dust residues, and for decontaminating in an environmentally controlled enclosure provided in a system created to define a washer/dryer/filtering area without the need for dividing walls between the areas.

The laundering decontamination process does not require a wall between its washer and dryer areas because of the washer system technology and because of the invention's environmental control. The reduction in contaminants released into the containment area and the elimination of the need for a wall between the washers and dryers are attributable to the features as disclosed and described, including safe delivery procedures that provide no contaminants are released into the containment area when dirty clothing bags are transferred into it, wetting of the clothing prior to pulling them out of their bags, improved air filtration and flow control systems in the containment area which do not allow contaminated air to flow toward the dryer air inlet, as well as HEPA filters and other means and methods for constant monitoring of the air in the containment area, the operator's breathing air area, the exhaust air, and the negative pressure introduced in the containment area with respect to the surrounding areas, the protection of the floors by placing six-mil polyethylene sheet thereon, a microprocessor controlled, programmable washer, testing the laundered reinforced protective clothing for residual contaminants to insure reliability of the laundering process and its results, a smooth wall finish on the containment area which substantially reduces adherence of contaminants to the wall surface and including a wash-down of all surfaces each day after laundering is complete, utilizing an enclosed waste water tank and filters which reduce the contact of the hot, contaminated water with the containment area ambient air, and reduction of human error in the closing and opening of vents by utilizing automatic, self-closing vents strategically placed in the containment area to direct the flow of clean air coming in to the inside of the area.

Vented rooms are provided to permit the operator to enter the washer/dryer/filtering area to perform the washing and drying procedures in such a manner so as to prevent the escape of contaminants from the enclosure and to the atmosphere and to provide that the washed clothes will not be contaminated during the drying procedures. The washed clothes will not be contaminated during the drying procedures in conjunction with the negative air engineering, the washer results repeatability, the method of handling the contaminated reinforced protective clothing before washing it, and the monitoring and testing procedures. At the same time, it is also provided for the operator's safety and for restricting levels of any of the above-mentioned contaminants on the clothes, if any, after laundering to at the most within the allowable safe level.

Facilities and methods are also provided for the filtering and safe disposal of the contaminated wash water. A large clean room area is separated from the washer/dryer/filtering area by walls and communicates with the washer/dryer/filtering area through the above-mentioned vented rooms. This large clean room area is used for the purpose of sorting, repairing, folding, and storing of the laundered reinforced protective clothing.

The present invention provides a decontamination process for laundering asbestos and/or lead, silica dust, titanium dioxide dust, or carbon dust contaminated reinforced protective clothing which decontaminates the reinforced protective clothing and which includes safety procedures, controls, and regular testings as intrinsic parts of the decontamination process.

The present invention provides facilities and process combined with a microprocessor-controlled washer technology and further combined with a containment-area-controlled environment.

The present invention provides a decontamination process for constant differential pressure monitoring, recording, and controlling and for constant airborne particulate monitoring, testing, and controlling.

The present invention provides for testing the reinforced protective clothing at regular predetermined intervals for contaminant content, prior to and after laundering.

The present invention provides a decontamination process for laundering woven or non-woven fabric, permeable or impermeable reinforced protective clothing containing asbestos and/or lead, silica dust, titanium dioxide dust, or carbon dust to provide clean, decontaminated reinforced protective clothing which leaves the laundering decontamination process substantially contaminant-free. The described sampling system of the present invention is not limited to sampling waste water and/or air from an asbestos, lead, silica dust, titanium dioxide dust, or carbon dust laundering decontamination process, but is also applicable to other contaminants as processed with the decontamination process of the present invention.

The present invention decontaminates the reinforced protective clothing through a laundering decontamination process which filters the contaminated waste water to below acceptable limits as set forth by U.S. Environmental Protection Agency regulations for disposal through a municipal sewer system, including processing the contaminated water through superior filtering means and reducing significantly the contact between the hot, contaminated waste water and the containment area ambient air.

Thus, it can be seen that the present invention accomplishes all of the stated objectives.

Although the invention has been illustrated by the preceding detailed description, it is not intended to be construed as being limited to the specific preferred embodiments employed therein.

Whereas particular embodiments of the invention have been described hereinabove, for purposes of illustration, it will be evident to those skilled in the art that numerous variations of the details may be made without departing from the invention as defined in the appended claims.

What is claimed is:

1. A decontamination process for laundering a reinforced full body suit, comprising:

(a) providing a washer area;

(b) providing a washer and dryer for laundering a contaminated reinforced full body suit in said washer area;

(c) providing a cleaning fluid filtering area having means for automatically monitoring and controlling cleaning fluid quality discharged from said washer area to the outside environment;

(d) providing a clean area for working on decontaminated clothes received from said washer area;

(e) automatically monitoring and controlling air quality in said washer area, in said cleaning fluid filtering area, and in said clean area and monitoring and controlling air quality of the air discharged to the outside environment; and (f) recycling and reusing the laundered and decontaminated reinforced full body suit.

2. A decontamination process as set forth in claim 1, wherein said reinforced full body suit comprises a dust-free full body suit composed of an environmentally contained, flexible, light weight base garment and further comprises flexible, light weight, heavy duty reinforcements on said base garment to resist wear through successive recycle and reuse.

3. A decontamination process as set forth in claim 2, wherein said reinforcements comprise a protective sleeve composed of a flexible, light weight material for providing heavy duty penetration resistance.

4. A decontamination process as set forth in claim 3, wherein said protective sleeve is composed of a material for providing penetration resistance from shot blasting.

5. A decontamination process as set forth in claim 4, wherein said protective sleeve is composed of a material comprising aramid fibers.

6. A decontamination process as set forth in claim 5, wherein said reinforcements comprise a protective knee composed of a flexible, light weight material for providing heavy duty wear resistance.

7. A decontamination process as set forth in claim 6, wherein said reinforcements comprise a protective seat composed of a flexible, light weight material for providing heavy duty wear resistance.

8. A decontamination process as set forth in claim 7, wherein said reinforcements comprise a protective knee, seat, and elbow composed of a flexible, light weight material for providing heavy duty wear resistance.

9. A decontamination process as set forth in claim 8, wherein said flexible, light weight base garment is composed of a polyester and cotton with a weight of about 3.7 oz. per square yard and a thread count of at least about 110×76 and wherein said flexible, light weight material for providing wear resistance comprises a denim of at least about 12 oz. per square yard.

10. A decontamination process for laundering a reinforced full body suit, comprising:

(a) providing a washer area;

(b) providing a washer and dryer for laundering a contaminated reinforced full body suit in said washer area, wherein said reinforced full body suit is composed of an environmentally contained, flexible, light-weight base garment and further comprises flexible, light-weight, heavy duty reinforcements on said base garment to resist wear through successive recycle and reuse;

(c) providing a cleaning fluid filtering area having means for automatically monitoring and controlling cleaning fluid quality discharged from said washer area to the outside environment;

(d) providing a clean area for working on decontaminated clothes received from said washer area; and (e) recycling and reusing the laundered and decontaminated reinforced full body suit.

11. A decontamination process as set forth mn claim 10, wherein said reinforcements comprise a protective sleeve composed of a flexible, light-weight material for providing heavy duty penetration resistance.

12. A decontamination process as set forth in claim 11, wherein said protective sleeve is composed of a material for providing penetration resistance from shot blasting.

13. A decontamination process as set forth in claim 12, wherein said protective sleeve is composed of a material comprising aramid fibers.

14. A decontamination process as set forth in claim 13, wherein said reinforcements comprise a protective knee composed of a flexible, light-weight material for providing heavy duty wear resistance.

15. A decontamination process as set forth in claim 14, wherein said reinforcements comprise a protective seat composed of a flexible, light-weight material for providing heavy duty wear resistance.

16. A decontamination process as set forth in claim 15, wherein said reinforcements comprise a protective knee, seat, and elbow composed of a flexible, light-weight material for providing heavy duty wear resistance.

17. A decontamination process as set forth in claim 16, wherein said flexible, light-weight base garment is composed of a polyester and cotton with a weight of about 3.7 oz. per square yard and a thread count of at least about 110×76 and wherein said flexible, light-weight material for providing wear resistance comprises a denim of at least about 12 oz. per square yard.

18. A decontamination process for laundering a reinforced full body suit, comprising:

(a) providing a washer area;

(b) providing a washer and dryer for laundering a contaminated reinforced full body suit in said washer area, wherein said reinforced full body suit is composed of an environmentally contained, flexible, light-weight base garment and further comprises a flexible, light-weight, heavy duty protective sleeve composed of a flexible, light-weight material for providing heavy duty penetration resistance; a protective knee composed of a flexible, light-weight material for providing heavy duty wear resistance; and a protective seat composed of a flexible, light-weight material for providing heavy duty wear resistance;

(c) providing a clean area for working on decontaminated clothes received from said washer area; and (d) recycling and reusing the laundered and decontaminated reinforced full body suit.

19. A decontamination process as set forth in claim 18, wherein said protective sleeve is composed of a material for providing penetration resistance from shot blasting.

20. A decontamination process as set forth in claim 19, wherein said protective sleeve is composed of a material comprising aramid fibers, wherein said flexible, light-weight base garment is composed of a polyester and cotton with a weight of about 3.7 oz. per square yard and a thread count of at least about 110×76, and wherein said flexible, light-weight material for providing wear resistance comprises a denim of at least about 12 oz. per square yard.

* * * * *